US009024709B2

(12) United States Patent
Joshi et al.

(10) Patent No.: US 9,024,709 B2
(45) Date of Patent: May 5, 2015

(54) TUNABLE EVANESCENT-MODE CAVITY FILTER

(75) Inventors: Himanshu Joshi, Houston, TX (US); Hjalti Hreinn Sigmarsson, West Lafayette, IN (US); Dimitrios Peroulis, West Lafayette, IN (US); William J. Chappell, Lafayette, IN (US); Xiaoguang Liu, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 888 days.

(21) Appl. No.: 13/122,370

(22) PCT Filed: Oct. 3, 2009

(86) PCT No.: PCT/US2009/059466

§ 371 (c)(1),
(2), (4) Date: Jun. 15, 2011

(87) PCT Pub. No.: WO2010/040119

PCT Pub. Date: Apr. 8, 2010

(65) Prior Publication Data

US 2011/0241802 A1 Oct. 6, 2011

Related U.S. Application Data

(60) Provisional application No. 61/102,717, filed on Oct. 3, 2009.

(51) Int. Cl.

| | |
|---|---|
| ***H01P 1/219*** | (2006.01) |
| ***H01P 7/06*** | (2006.01) |
| ***H01P 11/00*** | (2006.01) |

(52) U.S. Cl.
CPC *H01P 1/219* (2013.01); *H01P 7/06* (2013.01); *H01P 11/007* (2013.01)

(58) Field of Classification Search
CPC ..... H01P 11/007; H01P 1/219; H01P 7/06
USPC ..... 333/167, 186, 187, 202–212, 250, 231
See application file for complete search history.

(56) References Cited

U.S. PATENT DOCUMENTS 5,136,267 A * 8/1992 Cabot ..... 333/174
5,959,512 A 9/1999 Sherman (Continued)

OTHER PUBLICATIONS

Highly Loaded Evanescent Cavities for Widely Tunable High-Q Filters, Joshi et al., IEEE Microwave Symposium Jul. 2007, pp. 2133-2136.*

(Continued)

*Primary Examiner* — Benny Lee
*Assistant Examiner* — Rakesh Patel
(74) *Attorney, Agent, or Firm* — Purdue Research Foundation

(57) ABSTRACT

A tunable filter having an electronically tunable center frequency and dynamic bandwidth control over a large tuning range. High-Q continuously tunable evanescent-mode cavity resonators and filters using reliable RF MEMS actuators. One embodiment is a 3.4-6.2 GHz (1.8:1 tuning ratio) continuously tunable electrostatic MEMS resonator with quality factor of 460-530, with a volume of 18×30×4 mm including the actuation scheme and biasing lines. A tunable resonators is also disclosed with a 2.8:1 (5.0-1.9 GHz) tuning ratio, and Q of 300-650.

14 Claims, 23 Drawing Sheets

Filter in Cylindrical configuration (a) Side view (b) Bottom view showing the BW compensation network Drawings from A 3.4 – 6.2 GHz Continuously Tunable Electrostatic…

Novel tunable evanescent mode resonator design using an electrostatically actuated thin diaphragm released from the singlecrystal silicon device layer of an SOI wafer.

(56) References Cited

U.S. PATENT DOCUMENTS

| | | | | |
|---|---|---|---|---|
| 8,362,853 | B2 * | 1/2013 | Park | 333/186 |
| 2002/0053954 | A1 | 5/2002 | Shamsaifar et al. | |
| 2002/0180564 | A1 | 12/2002 | Lotz et al. | |
| 2004/0070471 | A1 | 4/2004 | Zhu et al. | |
| 2004/0212457 | A1 | 10/2004 | Eden et al. | |
| 2006/0061424 | A1 | 3/2006 | Arigliano | |
| 2007/0057739 | A1 | 3/2007 | Maligeorgos et al. | |
| 2007/0241843 | A1 | 10/2007 | D'Ostilio | |
| 2008/0252401 | A1 * | 10/2008 | Margomenos et al. | 333/210 |

OTHER PUBLICATIONS

Highly Loaded Evanescent Cavities for Widely Tunable High-Q Filters—ResearchGate, IEEE Microwave Symposium Jul. 2007.*

Kim et al., Digitally Frequency-Controllable Dual-Band WLAN Filters Using Micromachined Frequency-Tuning Elements, MEMS 2006, Istanbul, Turkey.

A. R. Brown et al., A Varactor-Tuned RF Filter, IEEE Trans. Microwave Theory & Tech., vol. 48, No. 7, pp. 1157-1160, Jul. 2000.

F. A. G. Miranda et al., Design and Development of Ferroelectric Tunable Microwave Components for Ku- and K-Band Satellite Communication Systems, IEEE Trans. Microwave Theory & Tech., vol. 48, No. 7, pp. 1181-1189, Jul. 2000.

A. Tombak et al., Voltage-Controlled RF Filters Employing Thin-Film Bariumstrontium-Titanate Tunable Capacitors, IEEE Trans. Microwave Theory & Tech., vol. 51, No. 2, pp. 462-467, Feb. 2003.

J. Nath et al., An Electronically Tunable Microstrip Bandpass Filter Using Thin-Film Barium—Strontium-Titanate (BST) Varactors, IEEE Trans. Microwave Theory & Tech., vol. 53, No. 9, pp. 2707-2712, Sep. 2005.

D. Peroulis et al., MEMS Devices for High Isolation Switching and Tunable Filtering, 2000 IEEE MTT-S Int. Microwave Symp. Dig., vol. 2, No., pp. 1217-1220 vol. 2, 2000.

A. Abbaspour-Tamijani et al., Miniature and Tunable Filters Using MEMS Capacitors, IEEE Trans. Microwave Theory & Tech., vol. 51, No. 7, pp. 1878-1885, Jul. 2003.

A. Pothier et al., Low-Loss 2-Bit Tunable Bandpass Filters Using MEMS DC Contact Switches, IEEE Trans. Microwave Theory & Tech., vol. 53, No. 1, pp. 354-360, Jan. 2005.

T. A. Schwarz et al., A Micromachined Evanescent Mode Resonator, 1999 European Microwave Conference Dig., vol. 2, pp. 403-406, Oct. 1999.

L. P. B. Katehi, Tunable Evanescent Mode Filters, DARPA Project Report, Dec. 2000.

X. Gong et al., Precision Fabrication Techniques and Analysis on High-Q Evanescent-Mode Resonators and Filters of Different Geometries, IEEE Trans. Microwave Theory & Tech., vol. 52, No. 11, pp. 2557-2566, Nov. 2004.

G. F. Craven et al., The Design of Evanescent Mode Waveguide Bandpass Filters for a Prescribed Insertion Loss Characteristic, IEEE Trans. Microwave Theory & Tech., vol. 19, No. 3, pp. 295-308, Mar. 1971.

W. C. Chew et al., Effects of Fringing Fields on the Capacitance of Circular Microstrip Disk, IEEE Trans. Microwave Theory & Tech., vol. 28, No. 2, pp. 98-104, Feb. 1980.

R. Levy et al., Transitional Combline/Evanescent-Mode Microwave Filters, IEEE Trans. Microwave Theory & Tech., vol. 45, No. 12, pp. 2094-2099, Dec. 1997.

A. Kirilenko et al., Evanescent-Mode Ridged Waveguide Bandpass Filters With Improved Performance, IEEE Trans. Microwave Theory & Tech., vol. 50, No. 5, pp. 1324-1327, May 2002.

R. V. Snyder et al., Bandstop Filters Using Dielectric Loaded Evanescent Mode Resonators, 2006 IEEE MTT-S Int. Microwave Symp. Dig., vol. 2, No., pp. 599-602 vol. 2, Jun. 6-11, 2004.

S. M. Hou et al., A High-Q Widely Tunable Gigahe1tz Electromagnetic Cavity Resonator, J. Microelectromech. Syst., vol. 15, No. 6, pp. 1540-1545, Dec. 2006.

H. Joshi et-al., Highly Loaded Evanescent Cavities for Widely Tunable High-Q Filters, 2007 IEEE MTT-S Int. Microwave Symp. Dig., pp. 2133-2136, Jun. 2007.

P. Ferrand et al., LTCC Reduced-Size Bandpass Filters Based on Capacitively Loaded Cavities for Q Band Application, Microwave Symposium Digest, 2005 IEEE MIT-S International, pp. 2083-2086, Jun. 2005.

R. G. Carter et al., Calculation of the Prope1ties of Reentrant Cylindrical Cavity Resonators, IEEE Trans. Microwave Theory & Tech., vol. 55, No. 12, pp. 2531-2538, Dec. 2007.

R. V. Snyder, New Application of Evanescent Mode Wave-Guide to Filter Design, IEEE Trans. Microwave Theory & Tech., vol. 25, No. 12, pp. 1013-1021, Dec. 1977.

* cited by examiner

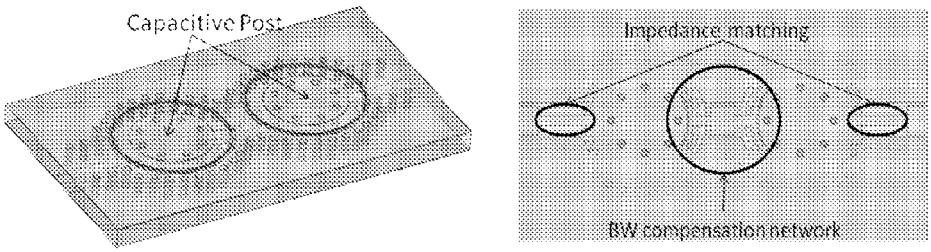
(a) (b)
Fig. 1. Filter in Cylindrical configuration (a) Side view (b) Bottom view showing the BW compensation network
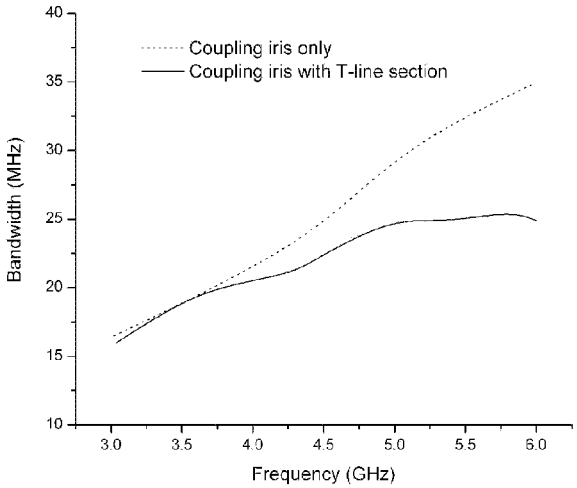
Fig. 2. Bandwidth of the filter with and without T-line section

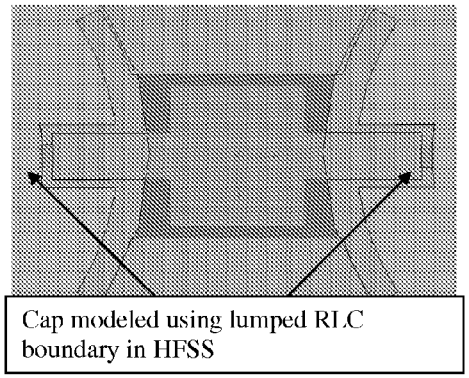
(a)
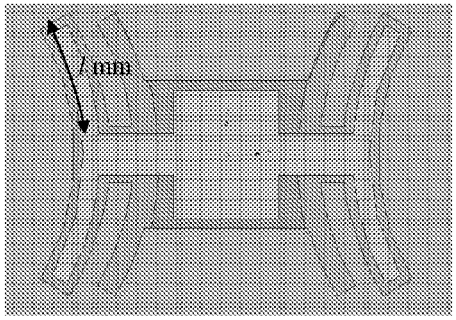
(b)
Fig. 3. Bandwidth compensation network (a) Using lumped capacitors (b) Using T-lines

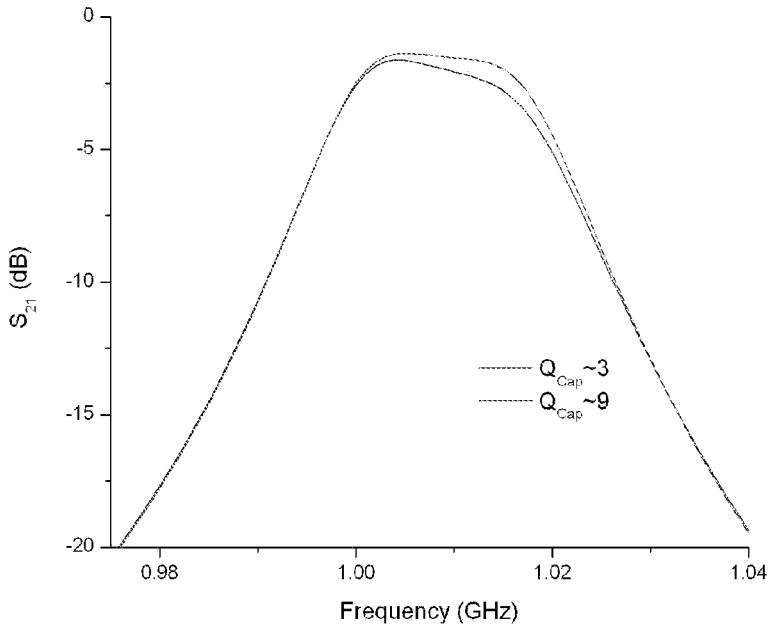
Fig. 4. Effect of capacitor Q on the filter pass band
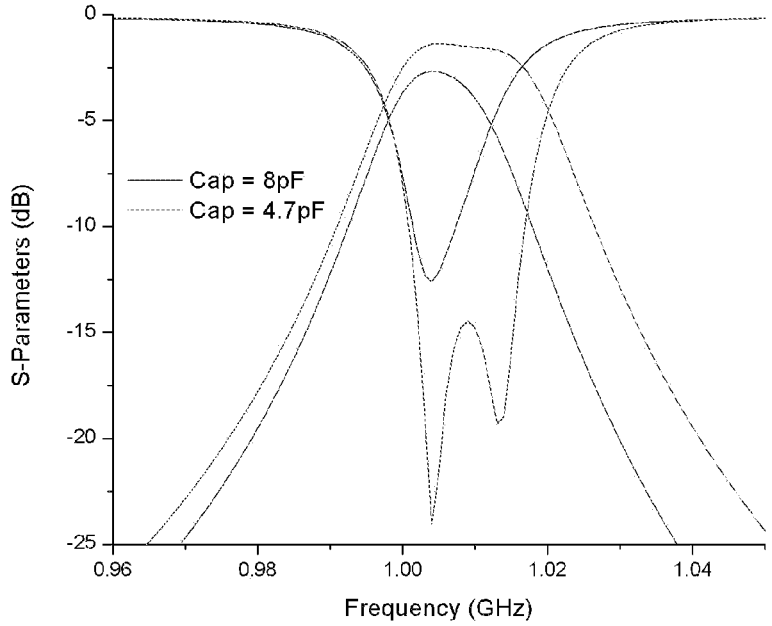
Fig. 5. Effect of capacitor value on the filter pass band

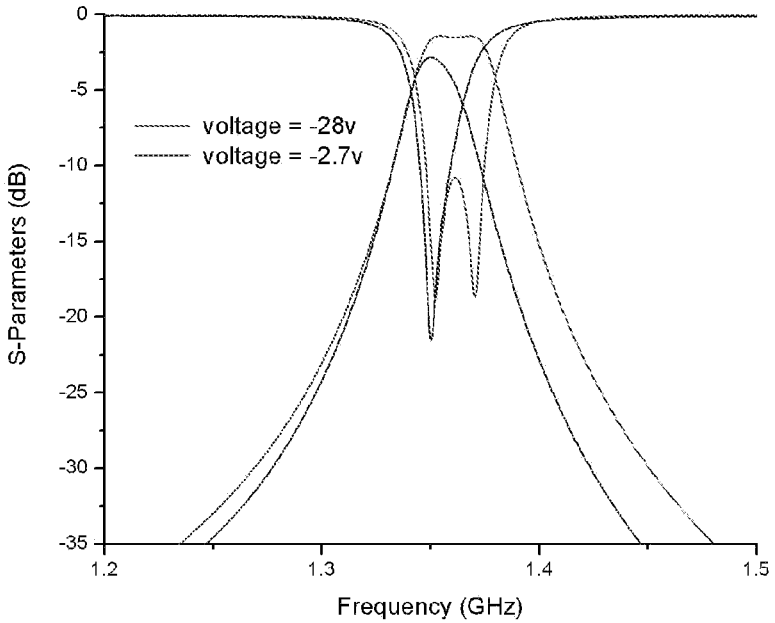
Fig. 6. Effect of capacitor value on the filter pass band
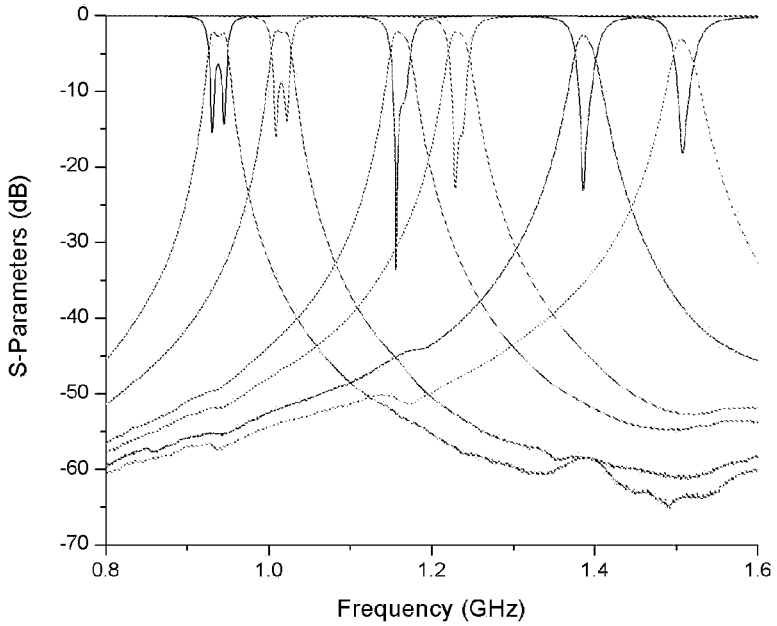
Fig. 7. Measured Results for nearly constant BW filter

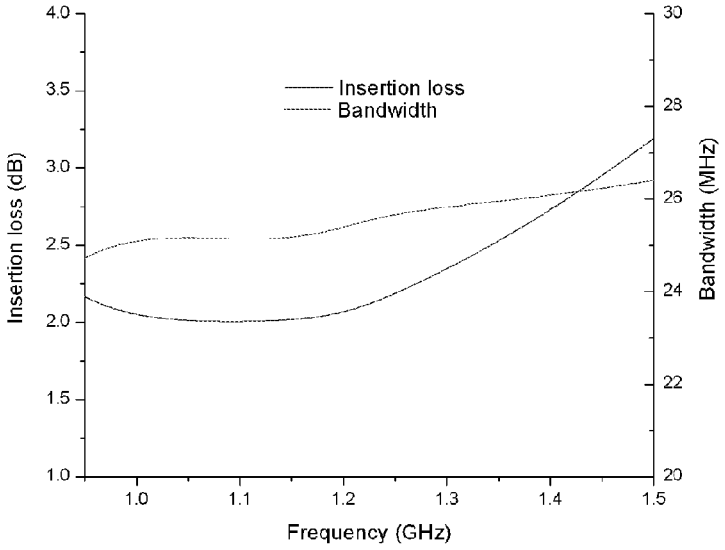
Fig. 8. IL and BW variation of the nearly constant BW filter
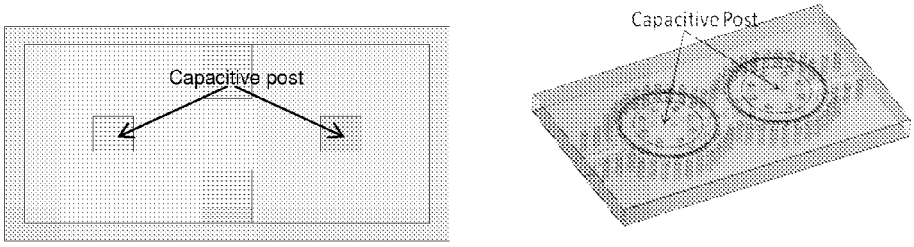
FIG. 9

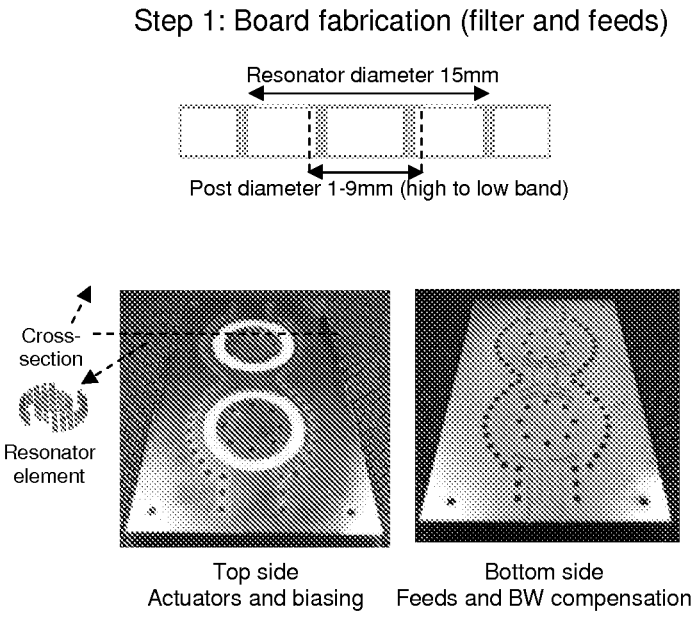
FIG.. 12
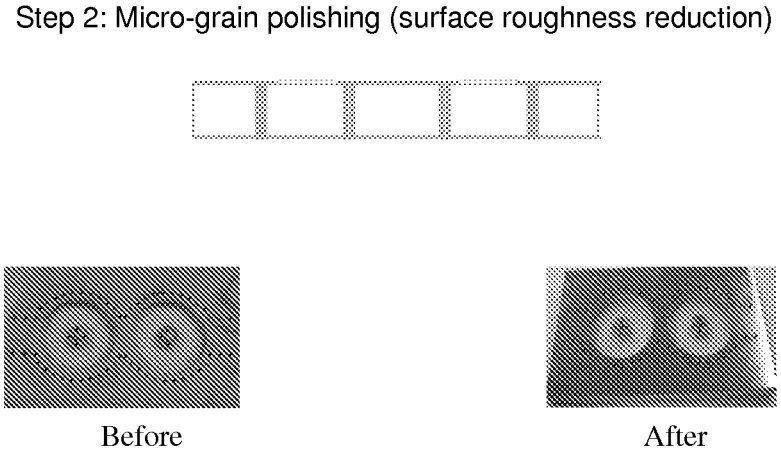
FIG. 13

Step 3: CVD Parylene-N coating (dielectric barrier)

Step 4: Copper lamination (tuning membrane) and plating of top vias

Filter with the laminated copper membrane
(the membrane is protected during plating for reduced stiffness)

Step 5: Piezoelectric actuator attachment (tuning mechanism)

Final filter with piezoelectric
actuators and connectors

Drawings from A 3.4 – 6.2 GHz Continuously Tunable Electrostatic…
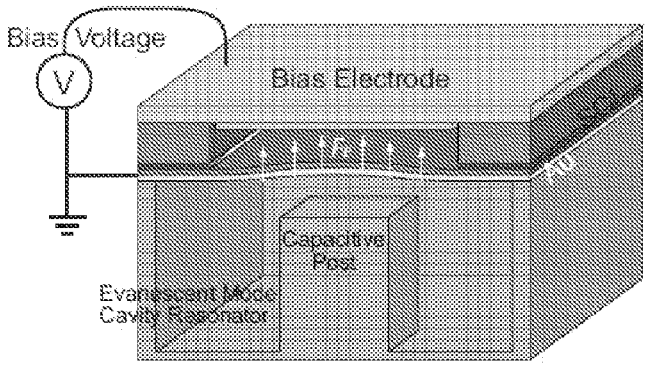
Fig. 18. Novel tunable evanescent mode resonator design using an electrostatically actuated thin diaphragm released from the singlecrystal silicon device layer of an SOI wafer.
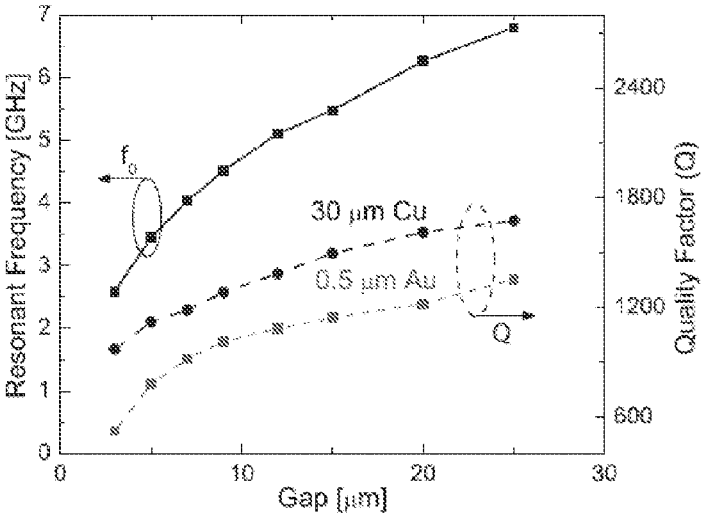
Fig. 19. Simulated resonant frequency and quality factor for the designed resonator.

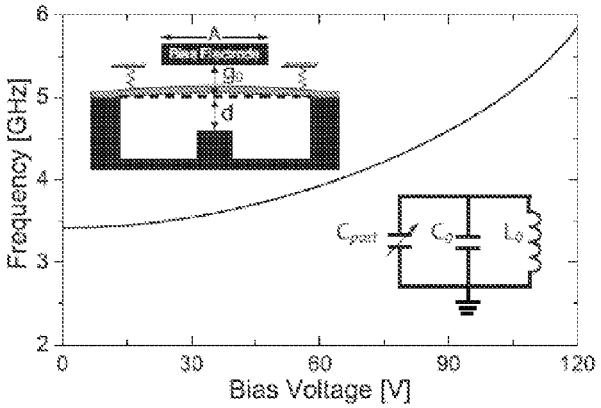
Fig. 20. Modelled resonant frequency dependence on the biasing voltage for the tunable resonator.
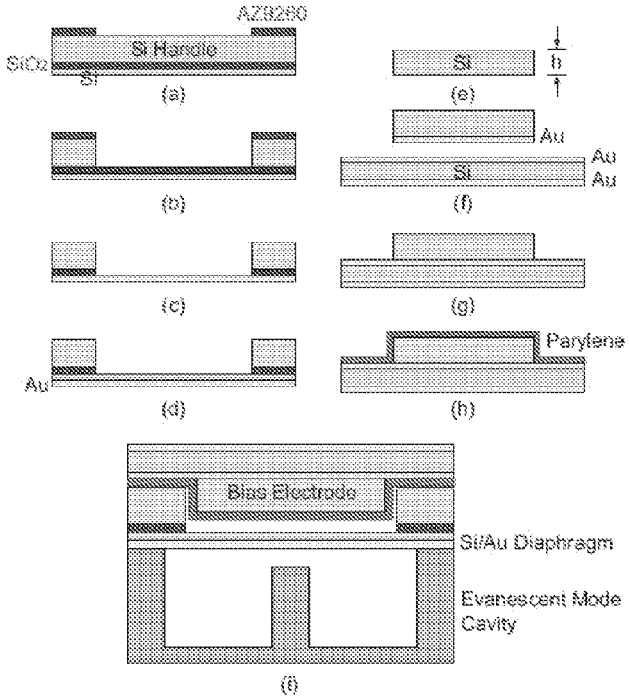
Fig. 21. Fabrication process for tunable evanescent mode resonator. (a) AZ9260 patterning; (b) DRIE; (c) Oxide etch; (d) Au sputter; (e) TMAH etch; (f) Au sputter; (g) Au-Au bonding; (h) Parylene deposition; (i) Tunable resonator assembly.

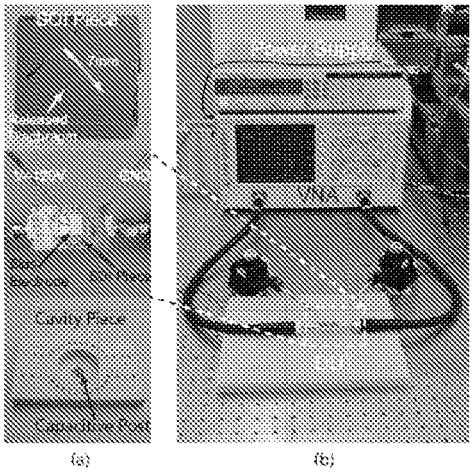
Fig. 22. Pictures of, (a) the fabricated parts; (b) measurement Setup.
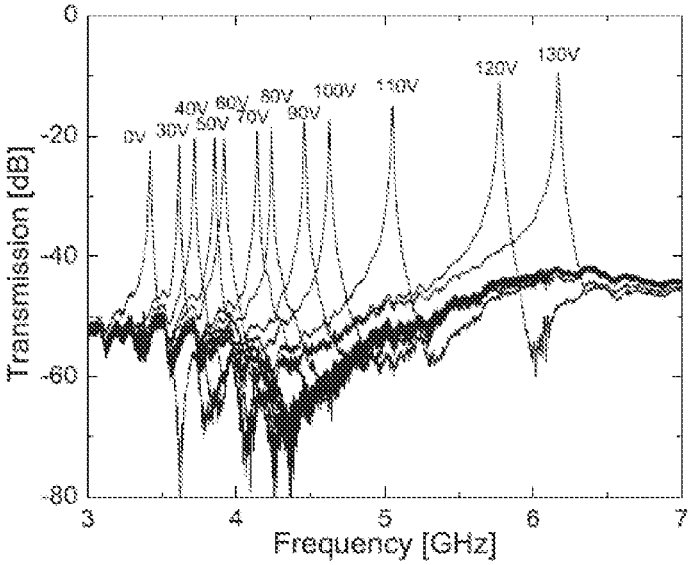
Figure 23. Measured transmission of the tunable evanescent mode resonator at different biasing voltages.

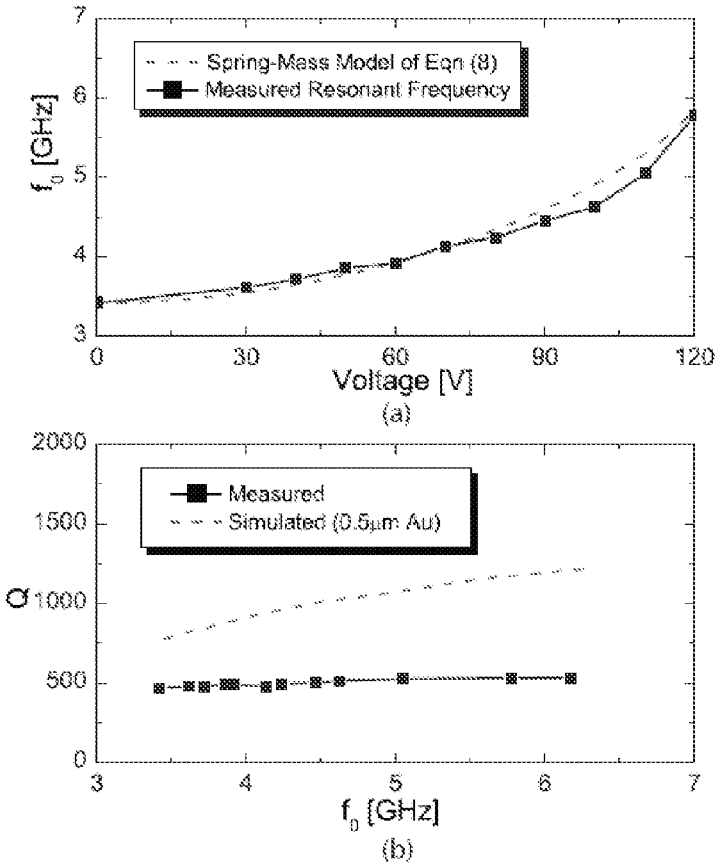
Fig. 24. Measured performances of the tunable resonator. (a) Frequency Tunability; (b) Quality Factor.

Drawings from High-Q Continuously Tunable Evanescent-mode Cavity
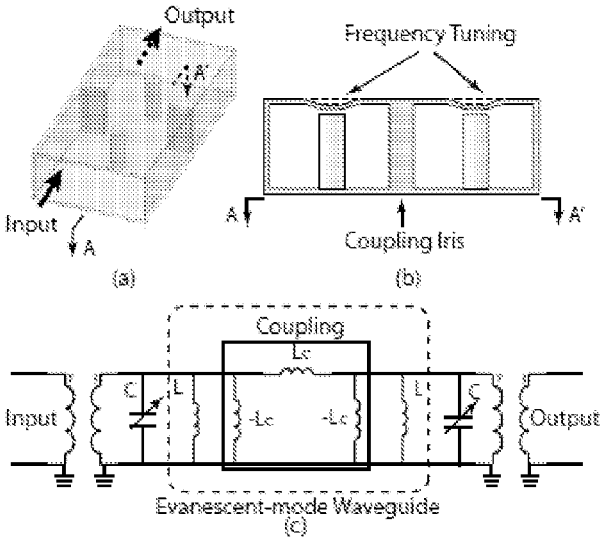
Fig. 25. Tunable Evanescent-mode cavity filter. (a) Capacitive post loaded evanescent-mode waveguide filter; (b) Frequency tuning; (c) Equivalent circuit.
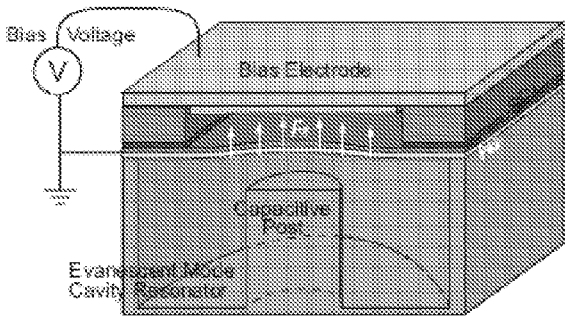
Fig. 26. Electrostatic RF MEMS Tunable Evanescent-mode cavity resonator [22].

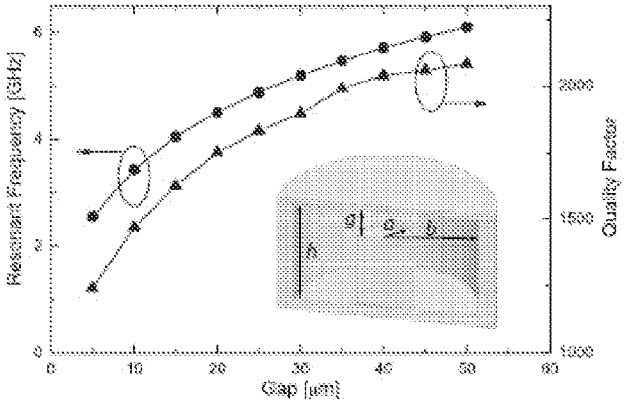
Fig. 27. Simulated resonant frequency (a) and quality factor (b) of an evanescent-mode cavity. Dimensions of the cavity are a = 1 mm , b = 8 mm, h = 4.5 mm.
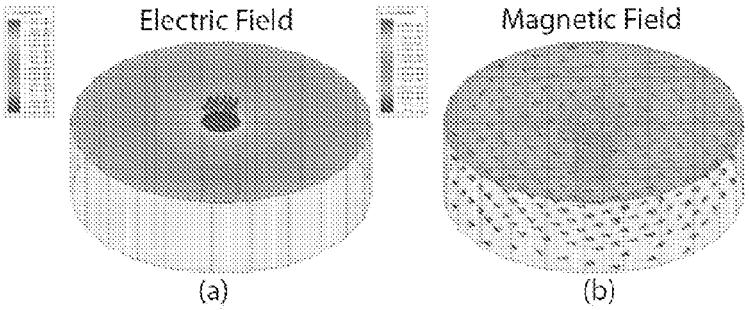
Fig. 28. Simulated electric (a) and magnetic (b) field distribution inside a cylindrical evanescent-mode cavity.

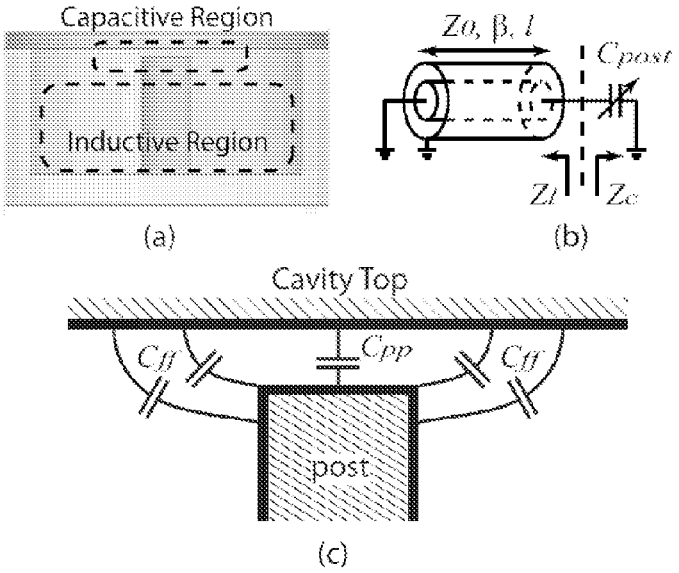
Fig. 29. Quasistatic model for highly-loaded evanescent-mode cavity resonator. (a) Cylindrical evanescent-mode resonator; (b) Equivalent circuit model; (c) Post capacitance.
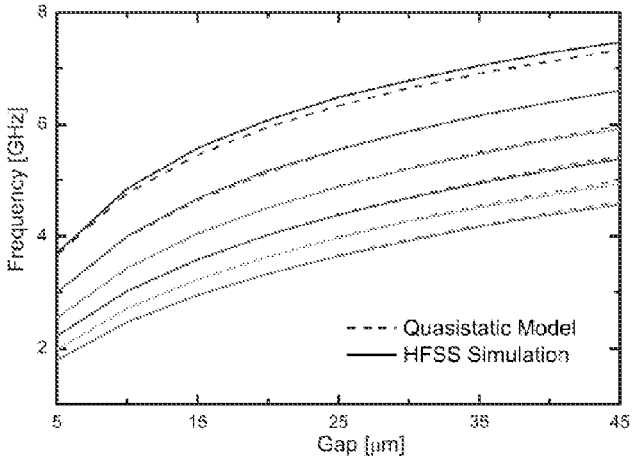
Fig. 30. Modeled and simulated resonant frequency of highly-loaded evanescent-mode cavity resonators.

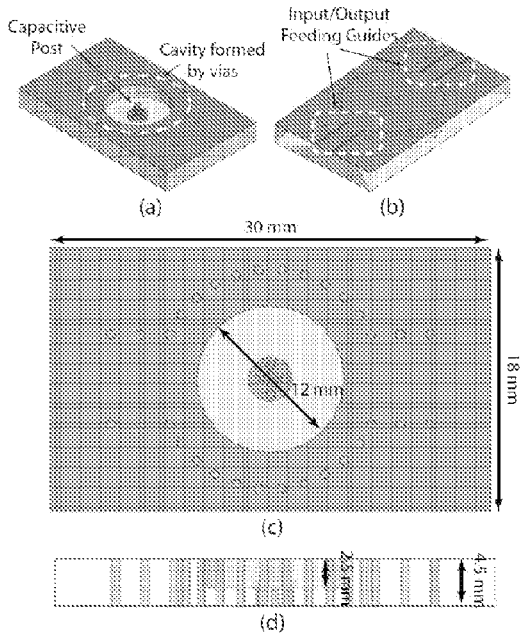
Fig. 31. Design illustration of the evanescent-mode cavity.
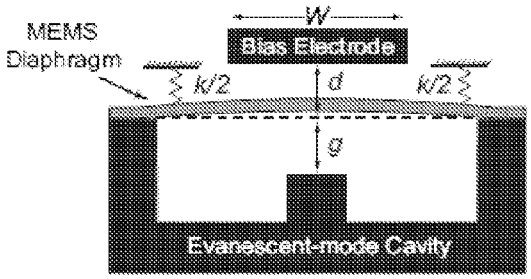
Fig. 32. 1-D spring-mass model of the electro-mechanical actuation of MEMS diaphragm [22]

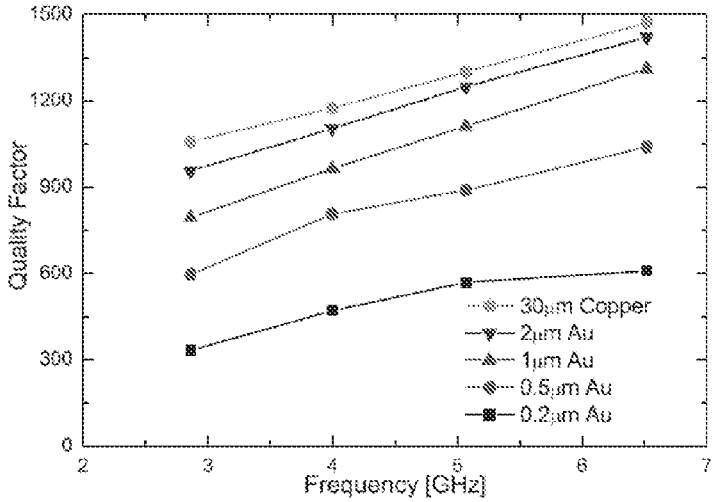
Fig. 33. Simulated effect of Au thin film thickness on the resonator quality factor.
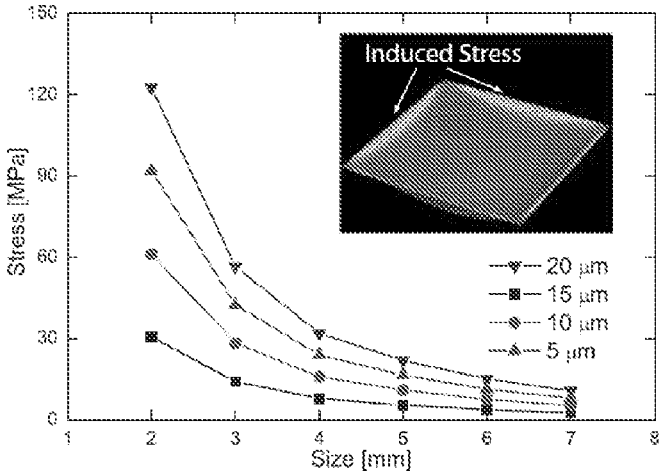
Fig. 34. Simulated induced stress in actuated MEMS diaphragms of different sizes.

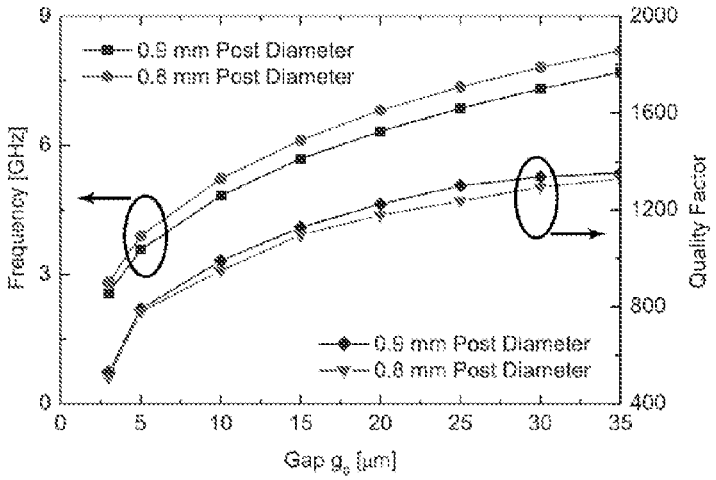
Fig. 35. Simulation of the resonant frequency and quality factor of designed tunable evanescent-mode cavity resonator.
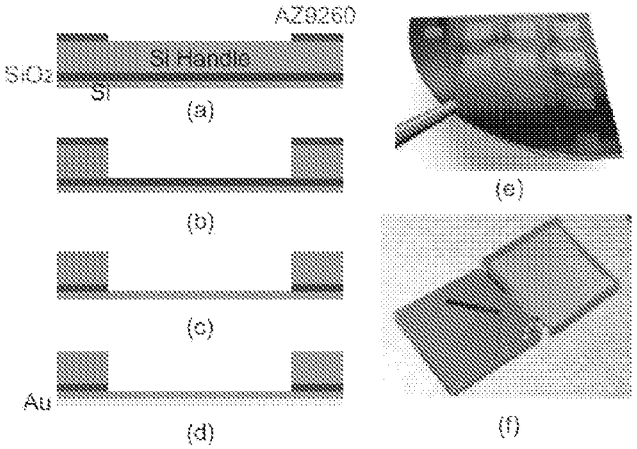
Fig. 36. Fabrication process for MEMS diaphragm: (a) AZ9260 patterning; (b) DRIE; (c) Oxide etch; (d) Au sputter; (e) Released diaphragm; (f) Fabricated MEMS Diaphragm piece.

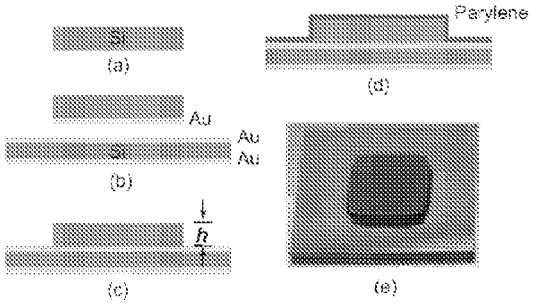
Fig. 37. Fabrication process for bias electrodes: (a) Top silicon piece; (b) Au sputter; (c) Au-Au thermal compression bonding; (d) Parylene deposition; (e) Fabricated electrode.
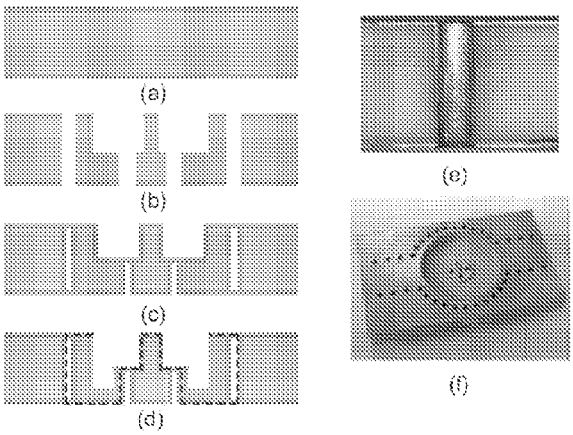
Fig. 38. Fabrication process for evanescent-mode cavity: (a) TMM substrate; (b) Via and post milling; (c) Cu plating; (d) Cavity milling; (e) Example of a plated via; (f) Fabricated cavity piece.

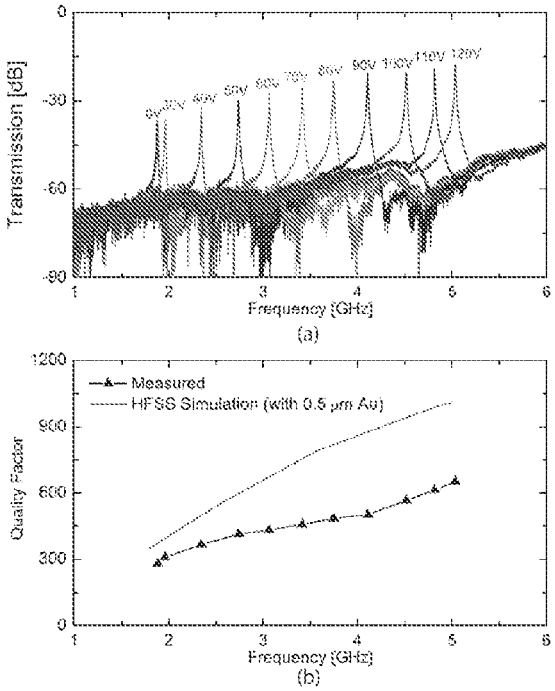
Fig. 39. Measured weakly-coupled transmission (a) and quality factor (b) of Resonator 1.

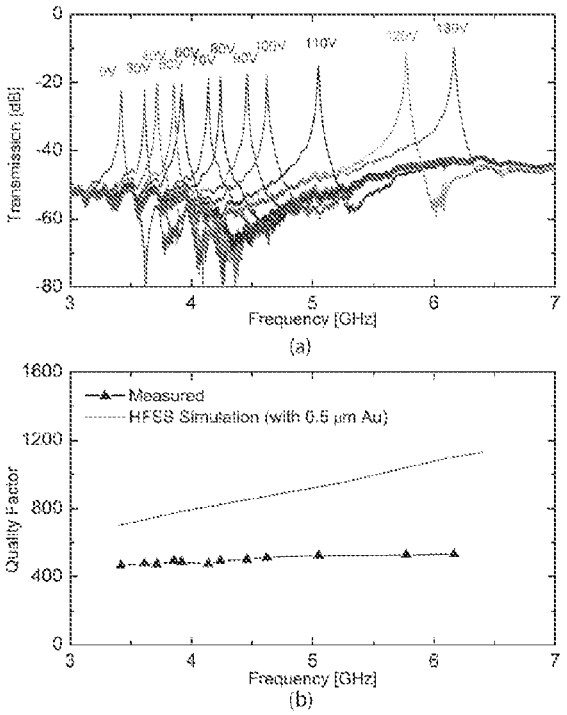
Fig. 40. Measured weakly-coupled transmission (a) and quality factor (b) of Resonator 2.
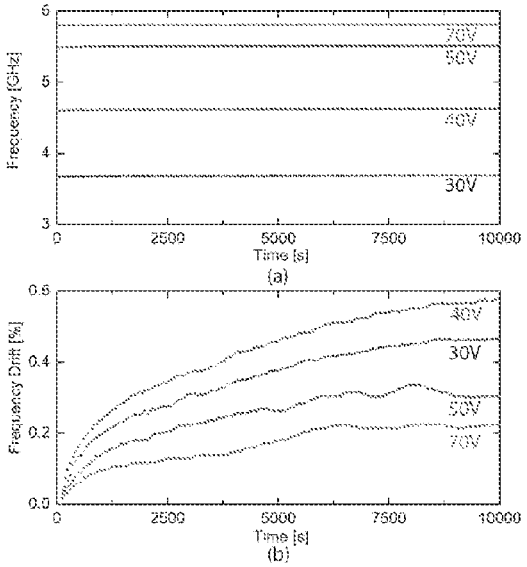
Fig. 41. Absolute frequency stability (a) and percentage drift (b) of an evanescent-mode tunable resonator.

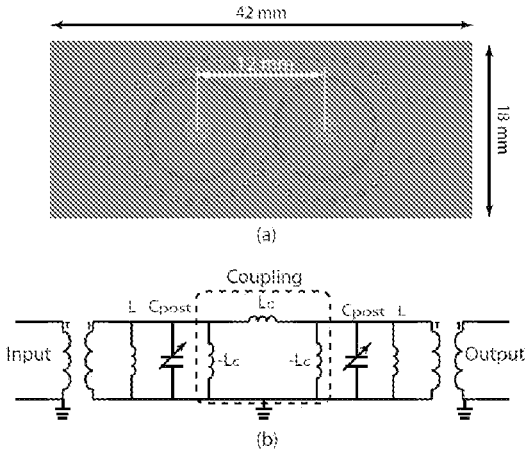
Fig. 42. Design illustration of the 2-pole tunable filter.
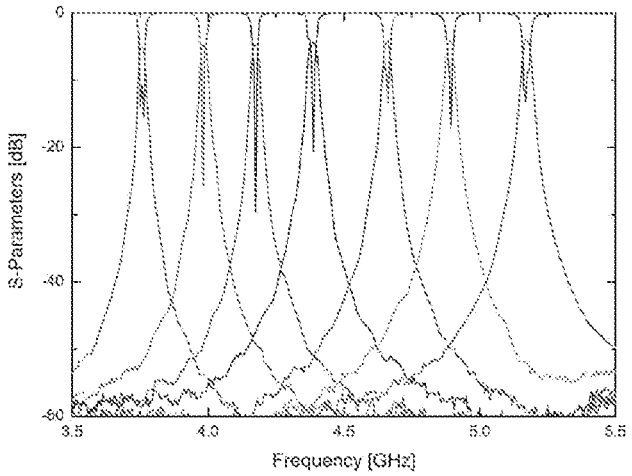
Fig. 43. Filter tuning performance.

TUNABLE EVANESCENT-MODE CAVITY FILTER

CROSS-REFERENCE TO RELATED APPLICATION

This application is related to U.S. Provisional Patent Application No. 61/102,717, filed Oct. 3, 2009, which application is hereby incorporated by reference along with all references cited therein.

BACKGROUND OF THE INVENTION

This invention relates to electronic filters, and more particularly to tunable filters of the type used in radio-frequency (RF) systems such as RF communications and test equipment, for example, in RF front-end sections of receivers and transmitters.

The continuous rapid development of wireless communication technologies has led to significant growth of RF and microwave devices and systems for both civilian and military applications. This is particularly true for mobile applications with increased demands for high efficiency, small volume, low weight and low cost. Furthermore, there is a defining trend to combine multiple wireless communication functionalities into a single frequency-agile platform for multi-band and multi-standard operation with a lower overall system cost. While digital technologies and the associated signal processing have enabled the implementation of frequency agility at base-band, the design and implementation of the RF front-end components remain a significant challenge for mobile systems. Tunable filters suitable for band selection and image rejection constitute typical examples.

Most of today's practical tunable filters are based on the ferromagnetic tunability Yttrium-Iron-Garnet (YIG) resonators. YIG based tunable filters exhibit very wide tuning range over multiple octaves and very high quality factors (Q) of 10,000 at 10 GHz. Nevertheless, the large volume and high power consumption (0.75-3 W) of YIG based tunable filters hinder their integration into mobile communication systems. Many alternative approaches have been proposed to make miniaturized tunable RF/Microwave filters. These approaches are predominantly based on planar transmission line resonators loaded with solid-state varactors, ferroelectric-tuned varactors and MEMS varactors, switches and switched capacitors, as described, for example, in the following papers:

A. R. Brown et al., "A Varactor-Tuned RF Filter," *IEEE Trans. Microwave Theory & Tech.*, Vol. 48, No. 7, pp. 1157-1160, July 2000;

F. A. G. Miranda et al., "Design And Development Of Ferroelectric Tunable Microwave Components For Ku- and K-Band Satellite Communication Systems," *IEEE Trans. Microwave Theory & Tech.*, Vol. 48, No. 7, pp. 1181-1189, July 2000;

A. Tombak et al., "Voltage-Controlled RF Filters Employing Thin-Film Bariumstrontium-Titanate Tunable Capacitors," *IEEE Trans. Microwave Theory & Tech.*, Vol. 51, No. 2, pp. 462-467, February 2003;

J. Nath et al., "An Electronically Tunable Microstrip Bandpass Filter Using Thin-Film Barium-Strontium-Titanate (BST) Varactors," *IEEE Trans. Microwave Theory & Tech.*, Vol. 53, No. 9, pp. 2707-2712, September 2005;

D. Peroulis et al., "MEMS Devices For High Isolation Switching And Tunable Filtering," 2000 *IEEE MTT-S Int. Microwave Symp. Dig.*, Vol. 2, No., pp. 1217-1220 vol. 2, 2000;

A. Abbaspour-Tamijani et al., "Miniature And Tunable Filters Using MEMS Capacitors," *IEEE Trans. Microwave Theory & Tech.*, Vol. 51, No. 7, pp. 1878-1885, July 2003; and A. Pothier et al., "Low-Loss 2-Bit Tunable Bandpass Filters Using MEMS DC Contact Switches," *IEEE Trans. Microwave Theory & Tech.*, Vol. 53, No. 1, pp. 354-360, January 2005.

While achieving significant progresses in terms of miniaturization and tuning, planar resonator based tunable filters have relatively low quality factor (Q) of less than 400-500. This is due to either the low-Q lumped elements, as in the case of solid-state varactors, and/or the low-Q of the resonator itself. Inherently high-Q resonators loaded with tuners that result in a graceful Q degradation while tuning are need for high-Q tunable filters. Several approaches have attempted to accomplish this by employing dielectric resonators, cavity resonators and high temperature superconductivity (HTS) resonators. However, their limited tuning range and the requirement for cryogenic cooling (in the case of HTS tunable resonators) makes them unsuitable for mobile systems in the near future.

Evanescent-mode waveguide filters have recently attracted interest for realizing low-loss, highly-selective tunable filters for reconfigurable RF front-ends. Reference is had to the following papers:

T. A. Schwarz et al., "A Micromachined Evanescent Mode Resonator," 1999 *European Microwave Conference Dig.*, Vol. 2, pp. 403-406, October 1999;

L. P. B. Katehi, "Tunable Evanescent Mode Filters," *DARPA Project Report*, December 2000; and X. Gong et al., "Precision Fabrication Techniques and Analysis on High-Q Evanescent-Mode Resonators and Filters of Different Geometries," *IEEE Trans. Microwave Theory & Tech.*, Vol. 52, No. 11, pp. 2557-2566, November 2004.

Compared to half-wave cavity resonators, evanescent mode resonators offer several advantages including substantially smaller volume and weight, larger spurious-free region and feasibility for monolithic integration while maintaining a very high-Q. It is well known that waveguides below cut off can be used to create microwave filters by introducing obstacles inside the guide, as described by G. F. Craven et al. in "The Design of Evanescent Mode Waveguide Bandpass Filters for a Prescribed Insertion Loss Characteristic," *IEEE Trans. Microwave Theory & Tech.*, Vol. 19, No. 3, pp. 295-308, March 1971, and by R. V. Snyder in "New Application of Evanescent Mode Wave-Guide to Filter Design," *IEEE Trans. Microwave Theory & Tech.*, Vol. 25, No. 12, pp. 1013-1021, December 1977. This concept finds wide applications in the form of evanescent mode filters, ridge waveguide filters and combline filters. See, e.g., R. Levy et al., "Transitional Combline/Evanescent-Mode Microwave Filters," *IEEE Trans. Microwave Theory & Tech.*, Vol. 45, No. 12, pp. 2094-2099, December 1997; A. Kirilenko et al., "Evanescent-Mode Ridged Waveguide Bandpass Filters With Improved Performance," *IEEE Trans. Microwave Theory & Tech.*, Vol. 50, No. 5, pp. 1324-1327, May 2002; and R. V. Snyder et al., "Bandstop Filters Using Dielectric Loaded Evanescent Mode Resonators," 2006 *IEEE MTT-S Int. Microwave Symp. Dig.*, Vol. 2, No., pp. 599-602 Vol. 2, 6-11 Jun. 2004.

The simplest and most practical type of waveguide obstacle is a conductive re-entrant post, which represents an effective shunt capacitance and is usually realized by a tuning screw. By changing this capacitance, i.e., the gap between the post and waveguide wall (FIG. 1), the center frequency of the filter can be changed. It has been proposed to create tunable evanescent-mode filters using metal thin films as waveguide walls and externally attached piezoelectric actuators for frequency tuning, as described by S. M. Hou et al. in "A High-Q Widely Tunable Gigahertz Electromagnetic Cavity Resonator," *J. Microelectromech. Syst.*, Vol. 15, No. 6, pp. 1540-1545, December 2006, and by H. Joshi et al. in "Highly Loaded Evanescent Cavities for Widely Tunable High-Q Filters," 2007 *IEEE MTT-S Int. Microwave Symp. Dig.*, pp. 2133-2136, June 2007. These techniques offer excellent RF performance but suffer from issues such as large overall volume, hysteresis, instability, and/or high power consumption. One alternative is electrostatic actuation, offering advantages as discussed herein, but there remains a need for improvements in actuation techniques for tunable evanescent-mode filters.

Another shortcoming of current filters in front-end receivers is that they have very limited tuning. Generally multiple filters are needed in a multi-band environment. Also, the filter bandwidth tends to vary linearly with frequency in evanescent-mode filters due to the coupling iris, which can be quite significant over tuning ranges of more than an octave.

SUMMARY OF THE INVENTION

The present invention generally provides improvements in tuning filters. According to one aspect of the invention, a tunable filter has an electronically tunable center frequency and dynamic bandwidth control over a large tuning range.

Another aspect of the invention is an electrostatically actuated tunable evanescent-mode cavity filter with a high quality factor (Q) and a wide tuning range.

The objects and advantages of the present invention will be more apparent upon reading the following detailed description in conjunction with the accompanying drawings.

BRIEF DESCRIPTION OF THE DRAWINGS

FIG. 1 illustrates an embodiment of a filter in cylindrical configuration, (a) side view and (b) bottom view showing a bandwidth compensation network.

FIG. 2 is a graph of the bandwidth of the filter with and without a transmission line (T-line) section.

FIG. 3 shows a bandwidth compensation network (a) using lumped capacitors and (b) using T-lines.

FIG. 4 is a graph of the effect of capacitor Q on the filter pass band.

FIGS. 5 and 6 are graph of the effect of capacitor value on the filter pass band.

FIG. 7 shows measured results for a nearly constant bandwidth filter.

FIG. 8 shows insertion loss (IL) and bandwidth variation of the nearly constant bandwidth filter.

FIG. 9 shows HFSS simulations of the quality factor of an evanescent-mode resonator.

FIG. 12 shows a board fabrication step for a filter and feeds.

FIG. 13 shows a micro-grain polishing step for surface and roughness reduction of the filter.

FIG. 18 shows a tunable evanescent mode resonator design according to one embodiment.

FIG. 19 is a graph depicting resonant frequency and quality factor of the resonator of FIG. 18.

FIG. 20 is graph depicting modelled resonant frequency dependence on biasing voltage of the resonator of FIG. 18.

FIG. 21 depicts a fabrication process for a tunable resonant evanescent mode resonator according to one embodiment.

FIG. 22 depicts a fabricated tunable resonant evanescent mode resonator and measurement setup according to one embodiment.

FIG. 23 is a graph depicting measured transmission of the resonator of FIG. 22.

FIG. 24 is a graph showing measured performances for frequency tenability and quality factor for the resonator of FIG. 22.

FIG. 25 is a diagram showing a tunable evanescent mode cavity filter according to one embodiment.

FIG. 26 is diagram showing an electrostatic RF MEMS tunable evanescent-mode cavity resonator according to one embodiment.

FIG. 27 is a graph showing simulated resonant frequency and quality of an evanescent-mode cavity according to one embodiment.

FIG. 28 is a diagram showing the simulated electric and magnetic field distribution inside a cylindrical evanescent-mode cavity according to one embodiment.

FIG. 29 is a diagram showing a quasistatic model for a highly-loaded evanescent-mode cavity resonator according to one embodiment.

FIG. 30 is a graph showing modeled and simulated resonant frequency of highly-loaded evanescent-mode cavity resonators according to one embodiment.

FIG. 31 is a diagram depicting an evanescent-mode cavity according to one embodiment.

FIG. 32 is a diagram depicting a 1-D spring-mass model of an electro-mechanical actuation of an MEMS diaphragm according to one embodiment.

FIG. 33 is a graph showing the simulated effect of Au thin film thickness on resonator quality factor.

FIG. 34 is a graph showing simulated induced stress in actuated MEMS diaphragms of different sizes.

FIG. 35 is a graph showing simulation of the resonant frequency and quality factor of a tunable evanescent-mode cavity resonator according to one embodiment.

FIG. 36 depicts a fabrication process for a MEMS diaphragm according to one embodiment.

FIG. 37 depicts a fabrication process for bias electrodes according to one embodiment.

FIG. 38 depicts a fabrication process for an evanescent-mode cavity according to one embodiment.

FIG. 39 is a graph depicting measured weakly-coupled transmission and quality factor of a resonator according to one embodiment.

FIG. 40 is a graph depicting measured weakly-coupled transmission and quality factor of a resonator according to a further embodiment.

FIG. 41 is a graph depicting absolute frequency stability and percent drift of an evanescent-mode tunable resonator according to one embodiment.

FIG. 42 is a diagram depicting a 2-pole tunable filter according to one embodiment.

FIG. 43 is a graph depicting filter tuning performance according to one embodiment.

DESCRIPTION OF PREFERRED EMBODIMENTS

Figure 10:
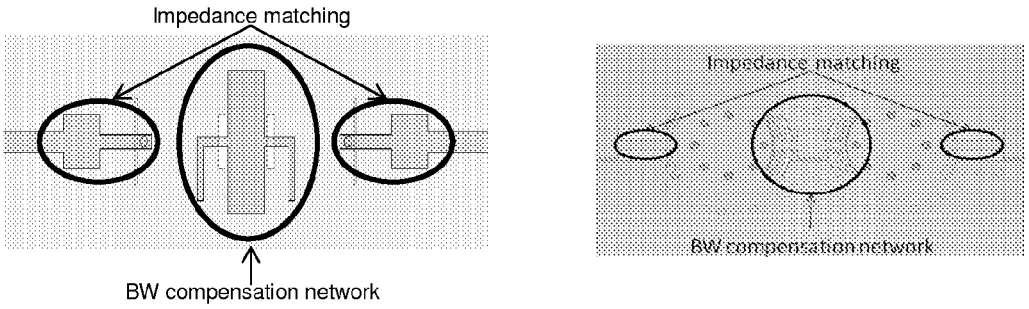
FIG. 10 shows a bandwidth compensation network.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates. The following description is divided into three parts each having its own series of numbered equations.

Part 1

One preferred embodiment of the present invention is a substrate-integrated, tunable evanescent-mode cavity filter with controllable bandwidth using surface mount varactors. The filter has a bandwidth compensation network that allows reduction/control over the bandwidth of the filter without affecting the filter's performance. The bandwidth compensation network also does not take up any additional volume. A 3D model of the concept is shown in FIG. 1.

FIG. 1 shows a second order filter, which uses piezoelectronic actuators mounted on top of the post in FIG. 1(*a*) to achieve electronic tuning of the center frequency. The back side of the filter is shown in FIG. 1(*b*), and shows the integrated T-line low-pass filter that helps reduce the bandwidth variation on tuning over large frequency ranges. Without the compensation network, the bandwidth would vary linearly with frequency due to the coupling iris, which can be quite significant over tuning ranges of more than an octave. Using this compensation network, the bandwidth variation can be reduced, as shown in FIG. 2.

This bandwidth compensation network can be further improved by using tunable lumped components to allow bandwidth control at one frequency, which would be particularly helpful in further reducing the bandwidth variation to come close to an almost constant bandwidth. It will also help reduce the insertion loss of the filter by increasing the bandwidth, depending on the relaxation in rejection requirements, interferer strength, etc, as a function of time. An embodiment of a bandwidth compensation network utilizing lumped capacitors is shown in FIG. 3(*a*) along with a T-line design in FIG. 3(*b*). The value of the capacitor can be obtained by equating the impedance of the capacitor to the open circuited lines given by equation 1.

By varying the capacitance value, the coupling through the bandwidth compensation network can be changed thus changing the bandwidth. A larger vale of C corresponds to a longer length of line 1 as can be seen from equation 2, which would result in more reduction in bandwidth. This is because the phase variation due to the longer length of the line will increase the coupling through the bandwidth compensation section at higher frequencies. The important factor that is to be considered is the Q of the capacitor, and its effect on the pass band of the filter. Based on full wave simulations it was observed that for a 4.7 pF capacitor, a Q of 10 is sufficient to achieve a good pass band response for a filter at about 1 GHz as shown in FIG. 4. The value of capacitor is chosen so as to get 25 MHz bandwidth at 1 GHz for the disclosed embodiment. Commonly available surface mount varactors can be used for this design without affecting the filter performance. The effect of the capacitor value on the filter pass-band is shown in FIG. 5, and indicates that the bandwidth can be changed from 25 MHz to 16 MHz on changing the capacitor value from 4.7 pF to 8 pF.

$$\frac{1}{j\omega C} = \frac{Z_o}{2j\tan(\beta l)} \tag{1}$$

$$C = \frac{2l\sqrt{\varepsilon_{eff}}}{Z_o c} \tag{2}$$

The concept has been verified through measured results as shown in FIG. 6 using a commercially available varactor from Infinion Technologies. The varactor can tune from 6 pF to 0.45 pF on changing the negative bias from 1V to 28V. The bandwidth of the filter changes from 38 MHz to 25 MHz on changing the negative bias voltage from 28V to 2.7V.

A major advantage of this concept is that it allows a significant control over bandwidth while dynamically tuning the filter, without lowering the quality factor. An illustration of this is that this concept allows an almost constant bandwidth over large tuning ranges, since the bandwidth can be reduced quite significantly as shown in FIG. 6. An example measurement result is shown in FIG. 7 for piezoelectric tuning from 0.95 to 1.5 GHz. The bandwidth variation is between 24.6 and 26.4 MHz with insertion loss between 2 and 3.2 dB, as shown in FIG. 8.

This filter is capable of dynamic band selection for intelligent or cognitive radios which can adapt to the current electrical environment and operate over a wide range of frequency bands. It also allows dynamic bandwidth selection to adapt to changing interferers. One embodiment of the filter has two evanescent-mode cavity resonators that are generated by forming via cages in a PCB substrate, for example, in a 125 mil thick Rogers® TMM3 microwave substrate with double-sided copper. The cavities are separated by a coupling iris which is formed by removing vias between the two resonators; the exact number of vias removed and the spacing between the resonators determines the bandwidth of the filter. The bandwidth increases almost linearly with frequency, and this variation is quite significant for large tuning ranges. To reduce this bandwidth variation, a transmission line bandwidth compensation network is designed which comes in parallel with the coupling iris. The transmission line compensation network can also incorporate surface mount varactors to allow tunable bandwidth. The design is done so that the low-Q of the varactors does not affect the filter performance. The patterns on both sides of the board can be generated using conventional PC board manufacturing processes, either a milling machine or photolithography. The tunable membrane is generated by laminating a thin copper foil onto the substrate where the bonding layer has a void where the capacitive post is situated. A piezoelectric disc actuator is then mounted on top of the cooper foil in order to move the membrane, which causes changes in the capacitance of the loading post and enables the frequency tuning. This capacitance change can also be achieved by using a microelectromechanical systems (MEMS) variable capacitor.

Figure 11:
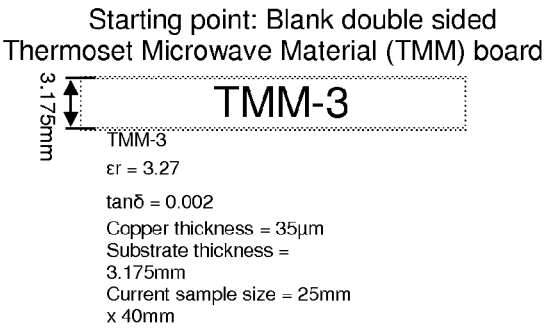
FIG. 11 shows blank double sided thermoset microwave material board.
Figure 14:
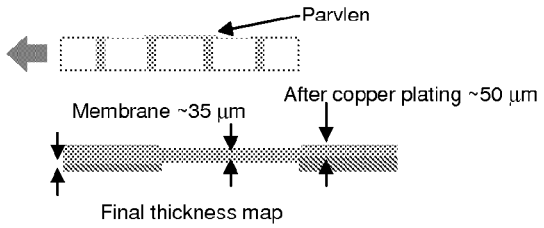
FIG. 14 shows CVD Parylene-N coating step for a dielectric barrier of the filter.
Figure 15:
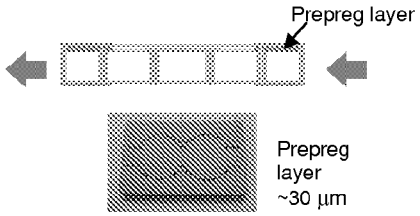
FIG. 15 shows a copper lamination tuning membrane and plating of top vias fabrication step of the filter.
Figure 16:
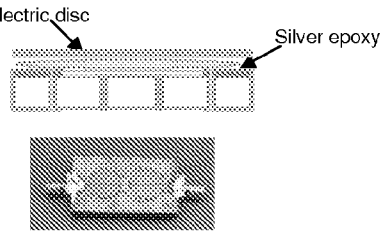
FIG. 16 shows a piezoelectric actuator attachment tuning mechanism fabrication step of the filter.
Figure 17:
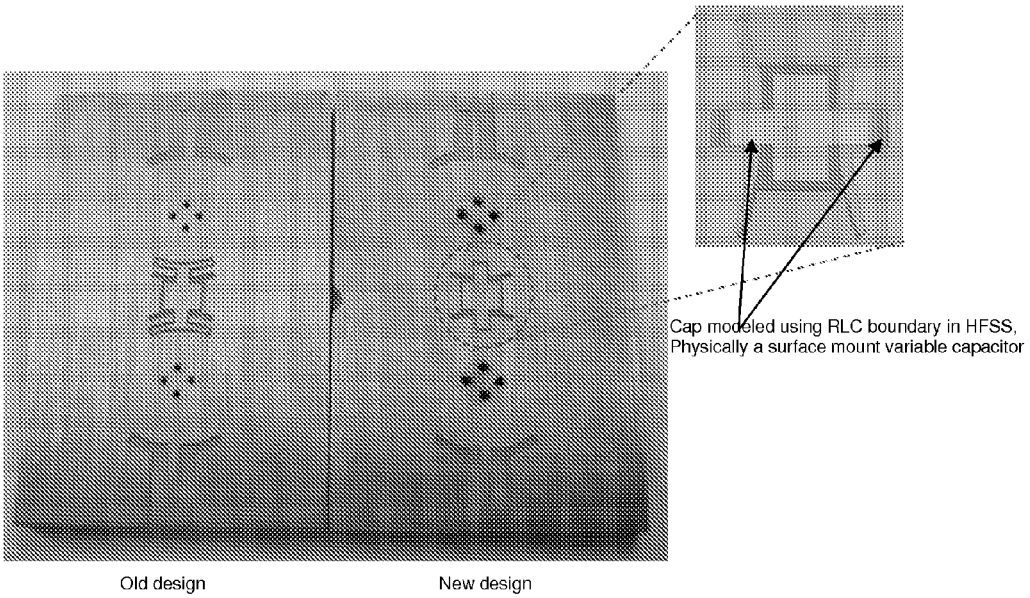
FIG. 17 shows a final filter fabrication step with a surface mount variable capacitor.

FIGS. 9 through 17 show various features of a filter embodiment and method of fabrication. The filter in this example is designed for a low band of 0.8-1.6 GHz. Using a varactor, the bandwidth of the filter can be tuned to achieve almost constant bandwidth. For the 0.95-1.5 GHz range the bandwidth can be set to be 25±1 MHz.

The new filter is a suitable component for tunable front end receivers and transmitters among other applications, and is especially suitable for enabling software-defined radio.

Further information about fabrication methods for use with the present invention may be found in the above-referenced paper by Gong et al. and in the following paper: P. Ferrand et al., "LTCC Reduced-Size Bandpass Filters Based on Capacitively Loaded Cavities for Q Band Application," *Microwave Symposium Digest,* 2005 *IEEE MIT-S International*, pp. 2083-2086, June 2005. Both papers are hereby incorporated herein by reference along with all references cited therein.

Part 2

Referring now to FIG. 18, another embodiment of the present invention is an electrostatically actuated MEMS tunable evanescent-mode resonator that, in one example, has a tuning range of 3.4-6.2 GHz (1.8:1) and Q of 460-530. The resonator uses a Silicon-on-Insulator (SOI) wafer (FIG. 18) with a biasing scheme. The device silicon layer is released to a movable diaphragm and a thin film of gold (Au) is sputtered on it to form the cavity ceiling. The resonant frequency is tuned by moving the diaphragm upwards after applying a DC voltage on a bias electrode placed above the diaphragm. Thus no biasing lines interfere with the RF fields. Furthermore, the nearly defect-free single-crystal silicon diaphragm provides a reliable and stable mechanical support. On the other hand, the highly conductive Au film ensures a high quality factor. The combination of the two offers a nearly ideal tuning scheme with no hysteresis and creep issues.

The resonant characteristics of capacitive-post-loaded evanescent-mode cavity resonator are well-studied. The resonant frequency and quality factor are both functions of the cavity size, post size and the gap between the post top and cavity ceiling. The evanescent mode resonator is the cavity equivalent of a lumped element resonator and can be approximated by a lumped element L-C tank. The resonant frequency $f_0$ is given by (1) in which $C_{post}$ represents the capacitance between the post and cavity ceiling.

$$f_0 \approx \frac{1}{2\pi\sqrt{L_0(C_0 + C_{post})}} \tag{1}$$

Because the post top area $A_{post}$ dimensions are far greater than the gap d (see FIG. 18), $C_{post}$ can be approximated by the parallel-plate capacitance formulae (2). Therefore, the resonant frequency's dependence on the gap d is given by (3)

$$C_{post} \approx \frac{\epsilon_0 A}{d} \tag{2}$$

$$f_0 \approx \frac{1}{2\pi\sqrt{L_0(C_0 + \epsilon_0 A/d)}} \tag{3}$$

Since $C_0$ is typically very small compared to Cpost, the resonant frequency f0 is approximately inversely proportional to the square root of the gap d. As a result, the frequency tuning range is dependent on the initial gap d0 and the maximum distance the diaphragm can deflect.

We use a simple 1-D spring-mass model to model the actuation of the diaphragm (FIG. 20). The relationship between the diaphragm's deflection x and bias voltage V for a circular diaphragm is given by (4), in which A is the area of the bias electrode, $g_0$ the initial actuation gap (FIG. 20) and k the spring constant for the diaphragm.

$$\epsilon_0 \frac{AV^2}{2(g_0 - x)^2} = kx. \tag{4}$$

The analytical solution to (4) is $$x = r_{real}(V, A, k, g0) = \frac{1}{3}g_0 + \frac{K}{6k} + \frac{2g_0^2 k}{K}, \tag{5}$$

where $$K = \sqrt[3]{k^2 - (108\epsilon_0 AV^2 + 8g_0^3 k + 12VJ)}, \tag{6}$$

$$J = \sqrt{-3\epsilon_0 A(-27\epsilon_0 AV^2 + 4g_0^3 k)}. \tag{7}$$

The relationship between the resonant frequency $f_0$ and V is then given by (8)

$$f_0 \approx \frac{1}{2\pi\sqrt{L_0(C_0 + \epsilon_0 A/d + r_{real}(V, A, k, g_0))}} \tag{8}$$

Since pull-in occurs at about $g_0/3$ deflection, the maximum tuning range $R_{max}$ is approximately given by (9)

$$R_{max} \approx \sqrt{\frac{d_0 + g_0/3}{d_0}}. \tag{9}$$

In order to achieve a higher tuning range, a small d and a large $g_0$ are desired. As shown in the next subsection though, careful balancing is needed between the desired tuning range and the required actuation voltage.

Although a larger $g_0$ results in a higher tuning range, it also yields a higher actuation voltage. The actuation voltage is also dependent on the actuation area A and the spring constant k. While $g_0$ is primarily determined by the tuning range requirement, A can be chosen to reduce the actuation voltage by increasing the size of the bias electrode.

The spring constant of a circular diaphragm is given by (10)

$$k = k' + k'' = \frac{16\pi Et^3}{3R^2(1 - \nu^2)} + 4\pi\sigma t, \tag{10}$$

where a and t are the diaphragm side length and thickness, E is the Young's modulus, σ the residual stress and v the Poisson's ratio. In the presence of practical residual stress (>5 MPa), the k_term dominates the spring constant value particularly for large diaphragms with radius over 1 mm Therefore, it is critical to achieve low residual stress in the sputtered Au film for low voltage operation.

The final design parameters are listed in Table. I. Ansoft HFSS (High Frequency Structure Simulator), available from Ansoft Cooperation (http://www.ansoft.com/products/hf/hfss/), was used for simulation, and the results for resonant frequency and quality factor of the design are shown in FIG. 19. FIG. 20 shows the resonant frequency's dependence on the bias voltage based on the model derived in this section.

TABLE I

| PARAMETERS FOR THE FINAL DESIGN | |
|---|---|
| Capacitive Post Diamter | 0.9 mm |
| Bias Electrode Size A | 5 × 5 $mm^2$ |
| Diaphragm Size | 7 × 7 $mm^2$ |
| Initial Capacitive Gap $d_0$ | 5 μm |
| Initial Actuation Gap $g_0$ | 45 μm |
| Residual Stress in Au σ | 30 MPa |

The gold skin depth is 1.24 μm at 4 GHz, assuming the conductivity of Au thin film is $4.1\times10^7$ Siemens/m. The deposited Au film on the diaphragm is only 0.5 μm. The thickness of the Au film is primarily determined by pull-in voltage considerations and by the desire to keep the single crystal SOI thickness much greater than the gold thickness. The penalty paid is a slightly reduced quality factor by approximately 200-300 as shown in FIG. 19.

The fabrication process of the tunable resonator involves standard microfabrication steps and conventional machining techniques. It consists of three parts: a) the SOI diaphragm piece, b) the bias electrode piece, and c) the cavity piece. FIG. 21 summarizes the fabrication process flow.

The fabrication of the SOI piece starts with patterning an AZ9260 photoresist layer on the handle layer side as an etching mask for deep reactive ion etching (DRIE). The buried oxide layer has very high selectivity (>200:1) to silicon in the DRIE process and serves as an etch stop. After etching through the handle layer by DRIE, the oxide is removed by diluted HF solution. The device silicon layer is released upon the removal of the oxide layer. The released diaphragm is nearly perfectly flat due to the extremely low residual stress in the device layer. A 0.5 μm thick Au layer is then sputtered on top of the released silicon diaphragm. The sputtering condition is carefully controlled to achieve a low tensile stress in the metal layer.

The bias electrode consists of two pieces of silicon bonded together. The thickness of the smaller piece h is controlled by wet etching in a 25% TMAH solution at 80° C. The etching condition ensures <0.1 μm thickness control and a very smooth surface finish. The two pieces are then metalized with Au on both sides and bonded together by Au—Au thermal compression bonding at 350° C. and 50 MPa pressure. A layer of 2 μm Parylene-C is deposited on the smaller piece side to create an insulation layer for biasing.

The cavity with the evanescent mode post is machined from a Rogers TMM substrate. The process starts with drilling vias that form the boundary of the resonant cavity and the feeding coplanar waveguide structure. The vias are electroplated with copper. Then a milling-machine is used to create the evanescent post by removing the substrate material around it. The removal of the substrate material also helps to increase the quality factor of the resonator by reducing dielectric loss. The vias and the post are then metalized by electroplating a thick layer of copper. The top copper layer of the cavity and the evanescent post is polished to reduce the surface roughness.

The SOI diaphragm piece is attached to the cavity by silver epoxy cured for 20 min at 125° C. The bias electrode is fixed on the SOI diaphragm by non-conductive epoxy cured at room temperature. After the assembly is done, two SMA connectors are soldered to both ends of the resonator to characterize the RF performance.

FIG. 22 shows the fabricated devices and a measurement setup including an Agilent 8722ES network analyzer. FIG. 23 shows the measured weak-coupled transmission of the tunable resonator under several biasing voltages. The resonator shows a total tuning range from 3.42-6.16 GHz under a bias voltage of 0-130 V. At 130 V, the movable diaphragm is pulled in to the top bias electrode. FIG. 24(*a*) shows the resonant frequency change under 0-120 V bias voltage. Although the spring constant of the square diaphragm was approximated by that of a circular diaphragm, the model shows very good agreement with experiment results.

The measured quality factor of the tunable resonator at each resonant frequency is shown in FIG. 24(*b*) and compared to the HFSS simulation result. The measured quality factor is 40% smaller than the simulated values and is less frequency dependent. This suggests that the loss in quality factor is primarily attributed to the low conductivity in the cured silver epoxy that connects the movable diaphragm to the bottom cavity.

A new electrostatically-tunable MEMS cavity resonator has been demonstrated which has a very high quality factor of 460-530 that is maintained thought a continuous tuning range of 3.4-6.2 GHz (1.8:1). The required electrostatic voltage ranges from 0-130 V. The biasing scheme and the fabrication process contribute to ensure a robust mechanical structure that preserves the high quality factor of the cavity. The primary material of the tuning membrane is single-crystal silicon that is coated with a thin gold layer. The resonator is useful as a key building block of a pre-select filter in a reconfigurable RF front-end.

Part 3

Referring to FIG. 25 and subsequent drawings, another embodiment of an electrostatically actuated tunable evanescent-mode resonator according to the present invention will now be described. The tunable resonator employs integrated electrostatically actuated diaphragms for tunable filters, and consists primarily of a thin diaphragm packaged on top of an evanescent-mode resonant cavity. The resonant frequency of the packaged cavity resonator is very sensitive to the gap between the capacitive post and the diaphragm. A bias electrode is placed above the diaphragm for electrostatic actuation as shown in FIG. 26. When a bias voltage is applied on the electrode, electrostatic force pulls the diaphragm away from the post and increases the resonant frequency. The resonator in one embodiment has a very high tuning range (2.8:1) while maintaining a high quality factor (650@ 5 GHz). The design is also inherently resistant to material and process tolerances due to the predominantly single-crystal nature of the tuner. Several stability experiments have been performed and are reported herein.

The discussion begins with the modeling of a single post evanescent-mode cavity resonator and the filter design can be accomplished by properly coupling multiple resonators. The resonant characteristics of capacitive-post-loaded evanescent-mode cavity resonator have been studied. See, e.g., the above-referenced paper by Gong et al., and the paper by R. G. Carter et al. in "Calculation of the Properties of Reentrant Cylindrical Cavity Resonators", IEEE Trans. Microwave Theory & Tech., vol. 55, no. 12, pp. 2531-2538, December 2007. The latter paper shows that, for cavities with simple and symmetrical geometries, such as a cylindrical re-entrant cavity (inset of FIG. 27), analytical solutions of the field distribution inside the cavity can be derived. For resonators with more complex geometries, full-wave numerical simulations can be used for analyzing the resonant characteristics. The resonant frequency and quality factor are found to be functions of the cavity size, post size and the gap between the post top and cavity ceiling. It has been shown that the conductive post represents an equivalent shunt capacitance and lowers the resonant frequency and quality factor of the cavity as the gap g decreases. In the high loading case, i.e., when g approaches 0, the frequency is very sensitive with respect to the gap g. A gap change in the order of microns can result in frequency changes of several Gigahertz. The penalty paid for this high frequency sensitivity is a decrease in the quality factor of the cavity resonator. FIG. 27 shows simulated frequency and quality factor of a typical highly loaded evanescent-mode cavity (a=1 mm, b=8 mm, h=4.5 mm) Simulation is done with Ansoft HFSS, which is a Finite Element Method (FEM) based full wave electromagnetic solver. It can be seen that the quality factor still remains much higher (500-2000 in the 2-6 GHz range) than planar transmission line resonators.

It is worth noting that in the highly-loaded case, the resonant wavelength is much larger than the size of the post and the resonant cavity. In other words, the size of the resonant cavity is significantly reduced by loading the cavity with a capacitive post. FIG. 28 shows the electric and magnetic field distribution inside a highly-loaded evanescent-mode cavity resonator. The uniform electric field (FIG. 28(*a*)) between the cavity top and the post suggests that the region above the post can be modeled by a lumped capacitor, while the toroidal magnetic field (FIG. 28(*b*)) around the post suggests that the post and sidewall of the cavity can be modeled by a shorted coaxial line, which represents an effectively inductor.

At resonance, $$Z_l + Z_c = 0. \tag{1}$$

$$jZ_0\tan\beta l + \frac{1}{j2\pi f C_{post}} = 0. \tag{2}$$

$$Z_0\tan\left(2\pi f\frac{l}{c_0}\right) = \frac{1}{2\pi f C_{post}}, \tag{3}$$

where f is the resonant frequency, l the post height, $c_0$ the free space speed of light, $C_{post}$ the effective capacitance of the post and $Z_0$ the characteristic impedance of the coaxial line, which is determined by the post diameter a and cavity diameter b.

Eqn. (3) can be solved numerically once the post capacitance $C_{post}$ is known. $C_{post}$ has been evaluated by using the parallel-plate capacitance $C_{pp}$ as a first-order approximation, as described, e.g., by H. Joshi et al. in "Highly Loaded Evanescent Cavities for Widely Tunable High-Q Filters," 2007 *IEEE MTT-S Int. Microwave Symp. Dig.*, pp. 2133-2136, June 2007. Preferably, the effect of fringing field capacitance $C_{ff}$ is taken into consideration. $C_{ff}$ has been estimated for a circular peripheral. L. Lewin, *Advanced Theory of Waveguides*, London, U.K.: Iliffe, 1951; and W. C. Chew et al., "Effects of Fringing Fields on the Capacitance of Circular Microstrip Disk," *IEEE Trans. Microwave Theory & Tech.*, Vol. 28, No. 2, pp. 98-104, February 1980. However, in the highly-loaded case, the fringing field capacitance due to the post side wall should be taken into account as well (FIG. 5(*c*)). In order to more accurately model the post capacitance $C_{post}$, an empirical fit may be carried out using data from full wave (Ansoft HFSS) simulations. The $C_{post}$ is found to be $$C_{post} = C_{pp} + 2.78C_{ff} + 0.04\text{ pF}, \tag{4}$$

where $$C_{pp} = \frac{\epsilon_0\pi a^2}{g}, \tag{5}$$

-continued $$C_{ff} = \epsilon_0 a\ln(a/2g). \tag{6}$$

With the knowledge of $C_{post}$, Eqn. (3) can be solved. FIG. 30 shows the modeled $f_0$-g relationship for post diameter of 0.6-1.6 mm (cavity radius b=8 mm, height h=4.5 mm) The model is accurate within 2% for a/b<0.3 and g/d<1/30.

It can be seen from FIG. 29 that in order to get larger tuning ratio, the initial capacitive gap $g_0$ must be small. For a given frequency range, it is therefore desirable to use capacitive post of a smaller diameter so that $g_0$ can be reduced.

An evanescent-mode cavity resonator is designed for 2-6 GHz range as vehicle to demonstrate the concepts. For size reduction and better integration with other circuit components, the evanescent-mode resonant cavity is integrated into a Rogers TMM microwave substrate. FIG. 31 shows the schematic drawing of the cavity design. Copper plated vias are used to connect the top and bottom metal layer to form the evanescent-mode cavity. The capacitive post is machined from the substrate and electroplated for electrical connection. Substrate integrated coplanar waveguides are used as input and output coupling structures. All dimensions of the design are shown in FIG. 31.

The above designed substrate-integrated cavity is enclosed by a Au-coated thin diaphragm to form the evanescent-mode cavity resonator. The reason for using a thin diaphragm is twofold: 1) the diaphragm preserves the natural current path and avoids any current distortion; and 2) the diaphragm completely isolates the biasing circuit from the resonant field inside the cavity, minimizing any energy leak to the bias circuits. Therefore, the diaphragm design inherently preserves the high Q of the resonant cavity.

As described in above, the diaphragm consists of a thin layer of sputtered Au on top of the released device layer of an SOI wafer. The single crystal silicon device layer is a defect free and stress-free material and provides reliable mechanical support for the Au layer. The buried-oxide layer of the SOI wafer also enables a highly tolerant fabrication process, details of which are discussed below.

Frequency tuning of the resonator is realized by electrostatically pulling the diaphragm away from the capacitive post. The mechanical actuation of the diaphragm can be effectively modeled by a 1-D spring-mass system (FIG. 32). The relationship between the diaphragm's deflection x and bias voltage V for a thin diaphragm is given by (7), in which A is the side length of the bias electrode, $d_0$ the initial actuation gap and k the spring constant for the diaphragm.

$$\epsilon_0\frac{A^2V^2}{2(d_0-x)^2} = kx. \tag{7}$$

The spring constant of a circular diaphragm is given by $$k = k' + k'' = \frac{16\pi Et^3}{3w^2(1-\nu^2)} + 4\pi\sigma t, \tag{8}$$

where w and t are the diaphragm radius and thickness, E is the Young's modulus, σ the residual stress and v the Poisson's ratio. As previously noted, the single crystal silicon device layer is a near stress free material and the residual stress is mainly due to the thin Au layer. In the presence of practical residual stress (>5 MPa), the k" term dominates the spring constant value particularly for large diaphragms with radii over 1 mm. This dominance of the stress induced stiffness is true for rectangular thin diaphragm as well.

The spring constant k for thin diaphragm is quite high (500 N/m for 10 MPa residual stress) compared with conventional MEMS devices. For low voltage operation, it is desirable to lower the spring constant k by reducing either the residual stress or the thickness of the Au film. However, the reduction of residual stress in the Au film is limited by fabrication process tolerances and extremely low stress (<5 MPa) is very difficult to achieve. Reduction of the thickness of Au film also comes with a penalty in excessive RF loss. The Au skin depth at 2-6 GHz range is 1.76-1.02 μm. It is desirable to have a Au layer thickness larger than the skin depth at this frequency range. Careful compromise must be made in choosing of Au film thickness from the mechanical point of view. FIG. 33 shows HFSS simulations of the quality factor of an evanescent-mode resonator with different Au thickness on the top wall. It can be seen that there is a significant drop in quality factor for Au thickness less than 0.5 μm at 2-6 GHz.

While a high spring constant k is limited by process tolerance and quality factor requirements, the size of the diaphragm can be increased to reduce the actuation voltage. Although a larger diaphragm has relatively insignificant impact on k (diaphragm size only comes into play in the k' term, which is dominated by the k" term), it can accommodate a larger bias electrode, therefore reducing the required actuation voltage.

Mechanical stability is an additional benefit of using a larger diaphragm. It is well known to the MEMS community that material creep results in performance drift over time. It has been shown that the creep rates in microscale devices are directly related to the induced stress/strain in the device materials. FIG. 34 shows the simulated induced stresses in rectangular diaphragms of different sizes at varying deflections. Simulation is done with Coventorware MEMS simulation package, available from Coventor Inc. It is shown that larger diaphragms are inherently lower stressed for a given deflection. Measurements on the mechanical stability of the tunable MEMS resonator are discussed below. The compromise of employing a relatively large diaphragm lies in slower response time and increased sensitivity to vibration and shock. For a given application all these factors need to be simultaneously considered and suitable compromises among the resonator's actuation voltage, frequency tunability, quality factor, mechanical robustness/stability, resistance to creep, speed and shock sensitivity need to be made. The final design parameters for this demonstration are listed in Table I. FIG. 35 shows the simulated resonant frequency and quality factor of the tunable resonators with 0.8 mm and 0.9 mm post diameters for covering different frequency ranges. A gold thickness of 0.5 μm is assumed in the simulation.

TABLE 1

DIMENSIONS OF THE DESIGNED TUNABLE RESONATORS

| | |
|---|---|
| Cavity Depth h | 4.5 mm |
| Cavity Diameter b | 12 mm |
| Post Diameter a | 0.8 and 0.9 mm |
| Electrode Size W | 5 mm |
| Diaphragm Size A | 7 mm |
| Residual Stress σ | 30 MPa |

The fabrication process of the tunable resonator involves standard microfabrication steps and conventional machining techniques. It consists of three parts: 1) the SOI diaphragm piece, 2) the bias electrode piece, and 3) the cavity piece. FIGS. 36-38 summarize the fabrication process flow.

The fabrication of the MEMS diaphragm starts with patterning an AZ9260 photoresist layer on the handle layer side as an etching mask for deep reactive ion etching (DRIE). The buried oxide layer has very high selectivity (>200:1) to silicon in the DRIE process and serves as an etch stop layer. The oxide layer is etched in Buffered-Oxide Etchant (BOE) after the handle layer is etched by DRIE. The device silicon layer is released after the removal of the oxide layer. The released diaphragm is flat due to the extremely low residual stress in the device silicon layer. A 0.5-μm thick Au layer is then deposited on top of the released silicon diaphragm by DC sputtering. The sputtering condition is carefully controlled to achieve a low tensile stress in the metal layer.

The bias electrode consists of two pieces of silicon bonded together. The thickness of the smaller piece h is controlled by timed wet etching in a 25% TMAH solution at 80° C. The etching condition ensures <0.1 μm thickness control and a very smooth surface finish. The two pieces are then metalized with Au on both sides and bonded together by Au—Au thermal compression bonding at 350° C. and 50 MPa pressure. A layer of 2 μm Parylene-C is deposited on the smaller piece side to create an insulation layer for biasing.

The cavity with the evanescent mode post is machined from a Rogers TMM substrate. The process starts with drilling vias that form the boundary of the resonant cavity and the feeding coplanar waveguide structure. The vias are electroplated with copper. Then a milling machine is used to create the evanescent post by removing the substrate material around it. The vias and the post are then metalized by electroplating a thick layer of copper. A second milling removes more substrate material to increase the quality factor of the resonator by reducing dielectric loss. The top copper layer of the cavity and the evanescent post is polished to reduce the surface roughness.

The SOI diaphragm piece is attached to the cavity by conductive silver epoxy. To accurately control the gap between the post and the diaphragm, the assembly is performed while the resonator is connected to a network analyzer. The resonant frequency is monitored in real time as the diaphragm piece is mounted on the resonator. The position of the diaphragm piece can be adjusted until the desired frequency is achieved. The assembled sample is then cured at room temperate until the solvent content of epoxy precursor fully evaporates. After the assembly is completed, two SMA connectors are soldered to both ends of the resonator to characterize the RF performance.

From a production point view, it is desirable to have accurate and repeatable control over the gap. However, the current technology using TMM substrate is limited by the surface roughness of substrate and the copper laminate. Bonding process with precise vertical alignment is being developed using Si micromachined evanescent cavities and holds great promise in achieving a low-cost reliable assembly of the tunable resonators.

RF measurements were taken with an Agilent 8722ES network analyzer. The tuning response of two resonators with different post sizes are shown in FIG. 39 and FIG. 40. FIG. 39(*a*) and FIG. 40(*a*) show the weakly coupled transmission of the two resonators. Sample 1 (post diameter of 0.9 mm) shows a fully analog tuning range of 5.0-1.9 GHz (2.8:1). A 1.8:1 (6.2-3.4 GHz) analog tuning ratio is demonstrated with Resonator 2 (post diameter of 0.8 mm) with 0-120 V bias. The extracted initial gaps g0 and bias gaps d for both resonators are listed in Table II.

TABLE II

EXTRACTED PARAMETERS OF THE MEASURED TUNABLE RESONATORS

| | Resonator 1 | Resonator 2 |
|---|---|---|
| Post Diameter | 0.9 mm | 0.8 mm |
| Tuning Range | 1.9-5.0 GHz | 3.4-6.2 GHz |
| Initial Capacitance Gap $g_0$ | 1.8 μm | 5 μm |
| Bia Gap $d_0$ | 40 μm | 45 μm |
| Quality Factor | 300-650 | 460-530 |

The measured quality factors of the tunable resonators are 300-650 at 1.9-5.0 GHz for resonator 1 and 460-530 at 3.4-6.2 GHz for resonator 2. The measured quality factors are lower than the simulated ones (FIG. 39(*b*) and FIG. 40(*b*)) by about 40%. The major reason for this reduction is the use of silver epoxy as the intermediate bonding material. The conductivity of the silver epoxy is around 100 S/m, which is orders of magnitude lower than those of Au ($4.1\times10^7$ S/m) and Cu ($5.8\times10^7$ S/m). The resonator quality factor can be improved by using higher conductivity material for bonding. Localized bonding techniques such as localized heating can be employed to achieve higher quality factor.

As previously discussed, material creep causes material property change over time when constant stress is applied. In MEMS structures this is typically seen when a stimulus is applied over longs periods of time. For example, the resonator may show a frequency drift if biased under a constant voltage for several hours. It is therefore important to consider this parameter in the filter design so the filter control becomes as simple as possible. The frequency stability of the fabricated resonators is tested by applying a constant bias voltage on the resonator and continuously recording the resonant frequency. Every two minutes ten samples were averaged to result in a recording. FIG. 41 shows the measured absolute and percentage frequency drifts at different bias voltages. It is worth noting that at higher bias levels (50 V and 70 V) the resonator exhibits smaller frequency drifts. The main reason for this reduced drift is that the capacitive gap g is larger at these bias voltages and the resonant frequency is less sensitive to the g change due to creep. This is a significant advantage of this design because it balances frequency tuning with stability.

A 2-pole tunable bandpass filter is designed by coupling two evanescent-mode tunable resonators. FIG. 42 shows the schematic drawing and equivalent circuit of the designed filter. Full wave simulation in HFSS is used for the design of the filter.

The designed filter is fabricated using process similar to that discussed above, and RF measurements were again taken with an Agilent 8722ES network analyzer. The two MEMS diaphragm tuners are biased individually with two 200 V voltage supplies. Because of assembly tolerances, the two resonators are not aligned at the same frequency initially and have to be adjusted individually. FIG. 43 shows the measured results for the fabricated tunable filter.

The filter is continuously tunable from 3.76-5.17 GHz with less than 120 V bias voltage. The insertion loss is <4 dB at 5.17 GHz for a bandwidth of 35.3 MHz. The extracted equivalent quality factor is 410 at 5 GHz. The value is a bit lower than the measured results from the individual resonators. This is mainly due to the increased RF radiation loss from the coupling slots.

Table III lists the recorded center frequency $f_0$, bandwidth BW, the bias voltages (V1 and V2) and the equivalent unloaded Q ($Q_u$).

TABLE III

MEASUREMENT SUMMARY OF THE 2-POLE TUNABLE FILTER

| | | | | | | | |
|---|---|---|---|---|---|---|---|
| $f_0$ [GHz] | 3.76 | 3.98 | 4.18 | 4.39 | 4.69 | 4.90 | 5.17 |
| BW [MHz] | 26.0 | 27.6 | 29.1 | 30.8 | 32.3 | 33.4 | 35.3 |
| I.L [dB] | 5.04 | 4.80 | 4.75 | 4.35 | 4.26 | 3.93 | 3.92 |
| $V_1$ [V] | 41.3 | 53.7 | 67.9 | 82.1 | 96.5 | 107.4 | 118.7 |
| $V_2$ [V] | 0 | 42.6 | 56.8 | 61.3 | 77.5 | 92.6 | 105.3 |
| $Q_u$ | 305 | 321 | 325 | 355 | 369 | 384 | 410 |

The modeling, design and fabrication techniques of high-Q, high-tunability evanescent-mode cavity based RF MEMS tunable resonators and filters have been described herein. Electrostatic actuation of thin-film MEMS diaphragm based on SOI wafers enables highly reliable operation with no hysteresis and excellent mechanical stability. Continuously tunable resonators from 1.9 to 5.0 GHz (2.8:1) with measured Q of 300-650 and from 3.4 to 6.2 GHz with Q of 460-530 have been demonstrated. The required electrostatic voltage ranges from 0-120 V. Stability measurements under constant bias shows frequency drift less than 0.2%/hour. The low frequency drift is attributed to the use of single crystal silicon as a mechanical support layer and the inherently low stress design. A 2-pole bandpass tunable filter is also designed and measured covering 3.76-5.17 GHz with insertion loss less than 4 dB for a bandwidth of 0.7%.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected. It should be noted that, as used herein, the term "RF" in intended to comprehend microwave frequencies as a particular portion of the RF spectrum, which also includes lower frequencies. All papers and other reference cited herein are incorporated herein in their entireties along with all references cited therein.

We claim:

1. A tunable cavity filter with bandwidth compensation to reduce variations in bandwidth during tuning of the center frequency of the filter, comprising;

at least first and second evanescent-mode cavities each having a flexible diaphragm over a capacitive post, each said flexible diaphragm and said capacitive post separated by a respective gap;

an actuator configured to vary the gap between the capacitive post of the first evanescent-mode cavity and the flexible diaphragm of the first evanescent-mode cavity and thereby vary the center frequency of said filter;

a coupling iris between said at least first and second evanescent-mode cavities; and a bandwidth compensation network in parallel with said coupling iris, said bandwidth compensation network comprising:

a surface;

a transmission-line section; and at least one surface mount varactor mounted on said surface.

2. The filter of claim 1, wherein said transmission-line section is on a bottom side of said filter spaced from at least one of said flexible diaphragms.

3. The filter of claim 2, wherein said actuator is an integrated piezoelectric actuator.

4. The filter of claim 1, wherein said actuator is an integrated piezoelectric actuator.

5. An electrostatically tunable evanescent-mode cavity resonator capable of tuning from a first frequency in the range of 1-3 GHz to a second frequency in the range of 4-8 GHz with a quality factor above 200, said cavity resonator comprising:

an evanescent-mode cavity having a flexible diaphragm over a capacitive post, said flexible diaphragm and said capacitive post separated by a gap, said flexible diaphragm formed of single-crystal silicon coated with a thin gold layer; and an electrostatic actuator configured to vary the gap between said capacitive post and flexible diaphragm, wherein said evanescent-mode cavity has a cavity depth of approximately 5 mm and a cavity diameter approximately twice the cavity depth, and wherein said capacitive post has a post diameter of approximately 1 mm.

6. The cavity resonator of claim 5, wherein said flexible diaphragm is formed from a silicon-on-insulator wafer.

7. The cavity resonator of claim 6, wherein the gap between said capacitive post and flexible diaphragm is nominally less than 10 μm and capable of being adjusted up to at least 30 μm.

8. The cavity resonator of claim 6, wherein a tuning range of said cavity resonator from the first frequency to the second frequency is approximately 2-6 GHz and said cavity resonator has a quality factor in the range of 300-600 throughout the tuning range thereof.

9. The cavity resonator of claim 6, wherein said electrostatic actuator includes a bias electrode disposed above said flexible diaphragm, and wherein said cavity resonator is tuned by pulling said flexible diaphragm upwardly by application of a DC voltage between said bias electrode and said flexible diaphragm.

10. The cavity resonator of claim 9, wherein the gap between said capacitive post and flexible diaphragm is nominally less than 10 μm and capable of being adjusted up to at least 30 μm.

11. The cavity resonator of claim 10, wherein a tuning range of said cavity resonator from the first frequency to the second frequency is approximately 2-6 GHz and said cavity resonator has a quality factor in the range of 300-600 throughout the tuning range thereof.

12. The cavity resonator of claim 5, wherein a tuning range of said cavity resonator from the first frequency to the second frequency is approximately 2-6 GHz and said cavity resonator has a quality factor in the range of 300-600 throughout the tuning range thereof.

13. The cavity resonator of claim 5, wherein said electrostatic actuator includes a bias electrode disposed above said flexible diaphragm, and wherein said cavity resonator is tuned by pulling said flexible diaphragm upwardly by application of a DC voltage between said bias electrode and said flexible diaphragm.

14. The cavity resonator of claim 5, wherein the gap between said capacitive post and flexible diaphragm is nominally less than 10 μm and capable of being adjusted up to at least 30 μm.

* * * * *

UNITED STATES PATENT AND TRADEMARK OFFICE

CERTIFICATE OF CORRECTION

PATENT NO. : 9,024,709 B2
APPLICATION NO. : 13/122370
DATED : May 5, 2015
INVENTOR(S) : Himanshu Joshi et al.

It is certified that error appears in the above-identified patent and that said Letters Patent is hereby corrected as shown below:

In the Specification

In column 1, line 11, before "BACKGROUND OF THE INVENTION," please add:

GOVERNMENT RIGHTS

This invention was made with government support under W15P7T-06-C-P635 awarded by the Defense Advanced Research Projects Agency. The government has certain rights in the invention.

Signed and Sealed this
Sixth Day of October, 2015

Michelle K. Lee

Michelle K. Lee
*Director of the United States Patent and Trademark Office*